US011517063B2

(12) United States Patent
Boutin

(10) Patent No.: US 11,517,063 B2
(45) Date of Patent: Dec. 6, 2022

(54) HELMET, PROCESS FOR DESIGNING AND MANUFACTURING A HELMET AND HELMET MANUFACTURED THEREFROM

(71) Applicant: 9376-4058 QUEBEC INC., Quebec (CA)

(72) Inventor: Gabriel Boutin, Quebec (CA)

( * ) Notice: Subject to any disclaimer, the term of this patent is extended or adjusted under 35 U.S.C. 154(b) by 297 days.

(21) Appl. No.: 16/342,137

(22) PCT Filed: Oct. 17, 2017

(86) PCT No.: PCT/CA2017/051234

§ 371 (c)(1),
(2) Date: Apr. 15, 2019

(87) PCT Pub. No.: WO2018/072017

PCT Pub. Date: Apr. 26, 2018

(65) Prior Publication Data

US 2019/0231018 A1 Aug. 1, 2019

Related U.S. Application Data

(60) Provisional application No. 62/409,006, filed on Oct. 17, 2016.

(51) Int. Cl.
*A42B 3/12* (2006.01)
*A42B 3/06* (2006.01)

(52) U.S. Cl.
CPC ..... *A42B 3/124* (2013.01); *A42B 3/065* (2013.01)

(58) Field of Classification Search
CPC ..... A42B 3/06; A42B 3/061; A42B 3/062; A42B 3/063; A42B 3/064; A42B 3/065;
(Continued)

(56) References Cited

U.S. PATENT DOCUMENTS 7,802,320 B2 9/2010 Morgan
7,866,377 B2 * 1/2011 Slaughter ..... F28F 13/00 165/148

(Continued)

FOREIGN PATENT DOCUMENTS

CA 2935566 A1 7/2015
EP 3000341 A1 3/2016

(Continued)

*Primary Examiner* — Shaun R Hurley
*Assistant Examiner* — Bao-Thieu L Nguyen
(74) *Attorney, Agent, or Firm* — DP IP Group; Franco S. De Liguori

(57) ABSTRACT

There is provided a helmet engageable with a human head portion. The helmet includes an inner shell, an outer shell and a shock absorbing layer. The shock absorbing layer is located between the inner shell and the outer shell, include at least one 3D structure and is defined by a plurality of interconnected 5 surfaces with a plurality of openings defined inbetween. A designing process is provided, including steps of providing a virtual inner shell model and outer shell model of the virtual helmet model, positioning virtual curves on the virtual inner shell/outer shell model, and generating virtual minimal surfaces. A manufacturing process is 10 further provided, including steps of conceiving the virtual helmet model using at least some steps of the designing process and additive manufacturing at least a portion of the helmet.

21 Claims, 17 Drawing Sheets

(58) Field of Classification Search
CPC ..... A42B 3/066; A42B 3/067; A42B 3/068; A42B 3/069; A42B 3/124; A42C 2/00
See application file for complete search history.

(56) References Cited

U.S. PATENT DOCUMENTS

| | | | | |
|---|---|---|---|---|
| 8,927,088 | B2 * | 1/2015 | Faden | A42B 3/064 428/178 |
| D795,500 | S * | 8/2017 | Chilson | D29/102 |
| 9,756,891 | B1 * | 9/2017 | McGhie | A42B 3/12 |
| 9,795,179 | B2 * | 10/2017 | Lytle | A42B 3/121 |
| 10,159,296 | B2 | 12/2018 | Pietrzak et al. | |
| 2006/0070170 | A1 * | 4/2006 | Copeland | A63B 71/10 2/411 |
| 2012/0151663 | A1 * | 6/2012 | Rumbaugh | A42B 3/065 2/411 |
| 2014/0068840 | A1 | 3/2014 | Nauman et al. | |
| 2015/0047110 | A1 * | 2/2015 | Chilson | A42B 3/28 2/414 |
| 2016/0302496 | A1 * | 10/2016 | Ferrara | A41D 13/015 |
| 2016/0318255 | A1 | 11/2016 | Ou et al. | |
| 2017/0196291 | A1 * | 7/2017 | Glover | A42B 3/063 |
| 2017/0303622 | A1 * | 10/2017 | Stone | A42B 3/064 |
| 2018/0027914 | A1 * | 2/2018 | Cook | A42B 3/124 |
| 2018/0192723 | A1 * | 7/2018 | Williams | A42B 1/08 |
| 2018/0249778 | A1 * | 9/2018 | Brandt | B32B 9/045 |
| 2018/0255862 | A1 * | 9/2018 | Ho | A42B 3/12 |
| 2020/0022444 | A1 * | 1/2020 | Stone | A42B 3/062 |
| 2020/0154803 | A1 * | 5/2020 | Goulet | A41D 31/285 |

FOREIGN PATENT DOCUMENTS

| | | | |
|---|---|---|---|
| EP | 3130243 | | 2/2017 |
| GB | 2490894 | B | 3/2015 |
| WO | WO 1998/46095 | A2 | 10/1998 |
| WO | WO 2015//103634 | | 7/2015 |
| WO | WO 2015/138657 | | 9/2015 |
| WO | 2016125105 | A1 | 8/2016 |
| WO | WO 2017/112653 | | 6/2017 |

* cited by examiner

HELMET, PROCESS FOR DESIGNING AND MANUFACTURING A HELMET AND HELMET MANUFACTURED THEREFROM

CROSS-REFERENCE TO RELATED APPLICATIONS

This application claims priority under 35USC§ 119(e) of U.S. provisional patent application 62/409,006 filed on Oct. 17, 2016, the specification of which is hereby incorporated by reference.

TECHNICAL FIELD

The technical field generally relates to protective helmets. More particularly, the technical field relates to a process for designing and manufacturing a helmet, and to a helmet manufactured therefrom. It also relates to a helmet including a shock absorbing layer defined by a 3D structure.

BACKGROUND

Protective helmets and headwear are used to protect a wearer's head from accidental trauma by protecting the head in case of high impact collisions. Helmets can be worn by workers, such as construction workers, or athletes in different sports including and without being limitative to cycling, football, baseball, hockey, lacrosse, skiing, and snowboarding, and horseback riding.

Typically, helmets are made of a hard and durable material configured to deflect and disperse the external forces applied thereto. Most helmets are made of a semi-rigid outer shell covering and distributing the force of impact to a compressible foam inner layer.

However, because they are typically worn for extended periods of time, helmets should be relatively lightweight while maintaining their head protection capabilities. For further comfort, some wearers also required that helmets are provided with increased aeration, while having good shock absorption properties. Therefore, there is always needs for improved protective helmet that can provide cranial protection while being comfortable for the wearer, i.e. relatively lightweight and aerated.

SUMMARY

In accordance with one aspect, there is provided a helmet engageable with a human head portion. The helmet includes an inner shell, an outer shell and a shock absorbing layer. The inner shell includes an internal surface configured to face at least a section of the human head portion when the helmet is worn. The outer shell includes an inner surface facing the inner shell and an outwardly facing surface, the outer shell being positioned at a distance from the inner shell and defining an internal volume between an outer surface of the inner shell and the inner surface of the outer shell. The shock absorbing layer is located between the inner shell and the outer shell, the shock absorbing layer including at least one 3D structure and is defined by a plurality of interconnected surfaces with a plurality of openings defined inbetween, the plurality of openings being oriented along at least two non-parallel axes to allow air circulation inside the shock absorbing layer, the at least one 3D structure filling at least partially the internal volume between the inner shell and the inner surface of the outer shell and maintaining the outer shell spaced-apart from the inner shell.

In accordance with another aspect, there is provided a helmet engageable with a human head portion. The helmet includes an inner shell, an outer shell and a shock absorbing layer. The inner shell includes an internal surface configured to face at least a section of the human head portion when the helmet is worn. The outer shell includes an inner surface facing the inner shell and an outwardly facing surface, the outer shell being positioned at a distance from the inner shell and defining an internal volume between an outer surface of the inner shell and the inner surface of the outer shell. The shock absorbing layer is located between the inner shell and the outer shell, the shock absorbing layer includes at least one 3D structure and is defined by a plurality of interconnected surfaces with a plurality of openings defined inbetween, the plurality of openings defining non-linear air circulation paths to allow air circulation inside the shock absorbing layer, the at least one 3D structure filling at least partially the internal volume between the inner shell and the inner surface of the outer shell and maintaining the outer shell spaced-apart from the inner shell.

In some embodiments, the shock absorbing layer is secured to the inner shell and the outer shell.

In some embodiments, the shock absorbing layer is made from a 3D-printed material.

In some embodiments, the inner shell and the outer shell are made from a 3D-printed material and printed as a single piece with the shock absorbing layer.

In some embodiments, the plurality of openings defined in the shock absorbing layer have a diameter ranging between 1 mm and 15 mm.

In some embodiments, the interconnected surfaces are based on minimal surfaces.

In some embodiments, the interconnected surfaces are based on a gyroid.

In some embodiments, the interconnected surfaces have a thickness ranging between 0.3 mm and 1.5 mm.

In some embodiments, the helmet includes a plurality of helmet portions secured together, wherein at least two of the helmet portions includes a respective one of the inner shell, a respective one of the outer shell, and a respective one of the shock absorbing layer extending between the respective ones of the inner and outer shells.

In some embodiments, the helmet includes a plurality of helmet portions, at least two of the helmet portions including a respective of one the shock absorbing layer and the at least two shock absorbing layers are sandwiched and extend between the inner shell and the outer shell.

In some embodiments, the shock absorbing layer includes a plurality of superposed and connected layers of the interconnected surfaces.

In some embodiments, at least one of the inner shell and the outer shell includes throughout apertures defined therein.

In some embodiments, the inner shell and the outer shell include throughout apertures with the throughout apertures defined in the outer shell being smaller in diameter than the throughout apertures defined in the inner shell.

In some embodiments, at least one portion of the shock absorbing layer is exposed outwardly.

In some embodiments, the plurality of interconnected surfaces defines a 3D periodic pattern.

In accordance with another aspect, there is provided a helmet engageable with a human head portion. The helmet includes an inner shell, an outer shell and a shock absorbing layer. The inner shell includes an internal surface configured to face at least a section of the human head portion when the helmet is worn. The outer shell includes an inner surface facing the inner shell and an outwardly facing surface, the outer shell being positioned at a distance from the inner shell and defining an internal volume between an outer surface of the inner shell and the inner surface of the outer shell. The shock absorbing layer is located between the inner and outer shells, the shock absorbing layer includes a 3D structure defined by a plurality of interconnected minimal surfaces, the 3D structure at least partially filling the internal volume between the inner shell and the inner surface of the outer shell and maintaining the outer shell spaced-apart from the inner shell.

In some embodiments, the shock absorbing layer is secured to the inner shell and the outer shell.

In some embodiments, the shock absorbing layer is made from a 3D-printed material.

In some embodiments, the inner shell and the outer shell are made from a 3D-printed material and printed as a single piece with the shock absorbing layer.

In some embodiments, the plurality of interconnected minimal surfaces defines a plurality of openings oriented along at least two non-parallel axes to allow air circulation inside the shock absorbing layer.

In some embodiments, the plurality of openings defined in the shock absorbing layer have a diameter ranging between 1 mm and 15 mm.

In some embodiments, the interconnected minimal surfaces have a thickness ranging between 0.3 mm and 1.5 mm.

In some embodiments, wherein the plurality of interconnected minimal surfaces is based on a gyroid.

In some embodiments, the helmet includes a plurality of helmet portions secured together, wherein at least two of the helmet portions includes a respective one of the inner shell, a respective one of the outer shell, and a respective one of the shock absorbing layer extending between the respective ones of the inner and outer shells.

In some embodiments, the helmet includes a plurality of helmet portions, at least two of the helmet portions including a respective of one the shock absorbing layer and the at least two shock absorbing layers are sandwiched and extend between the inner shell and the outer shell.

In some embodiments, the shock absorbing layer includes a plurality of superposed and connected layers of the interconnected minimal surfaces.

In some embodiments, at least one of the inner shell and the outer shell includes throughout apertures defined therein.

In some embodiments, the inner shell and the outer shell includes throughout apertures with the throughout apertures defined in the outer shell being smaller in diameter than the throughout apertures defined in the inner shell.

In some embodiments, at least one portion of the shock absorbing layer is exposed outwardly.

In some embodiments, the plurality of interconnected minimal surfaces defines a 3D periodic pattern.

In accordance with another aspect, there is provided a process for designing a virtual helmet model using a processor, the virtual helmet model being representative of at least a portion of a helmet. The process includes steps of: providing a virtual inner shell model and a virtual outer shell model of the virtual helmet model, the virtual outer shell model being positioned outwardly and spaced-apart from the virtual inner shell model to define an internal volume inbetween; positioning virtual curves on the virtual inner shell model and the virtual outer shell model; and generating virtual minimal surfaces in the internal volume using the virtual curves, the virtual minimal surfaces being connected to the virtual inner shell model and the virtual outer shell model to provide a shock absorbing layer between the virtual inner and outer shell models.

In some embodiments, the virtual curves are spaced-apart from one another.

In some embodiments, positioning virtual curves on the virtual inner shell model and the virtual outer shell model includes steps of: positioning a first set of virtual curves on one of the virtual inner shell model and the virtual outer shell model; and positioning a second set of virtual curves on the other one of the virtual inner shell model and the virtual outer shell model using the position of the first set of virtual curves, wherein each one of the virtual curves of the second set corresponds to a respective one of the virtual curves of the first set.

In some embodiments, each one of the virtual curves of the second set corresponding to a respective one of the virtual curves of the first set define a curve alignment which extends substantially normal to a junction with the virtual inner shell model.

In some embodiments, positioning virtual curves on the virtual inner shell model and the virtual outer shell model includes steps of: defining at least one virtual intermediate level between the virtual inner shell model and the virtual outer shell model; positioning a first set of virtual curves on one of the virtual inner shell model, the virtual outer shell model, and at least one of the at least one virtual intermediate level; positioning second sets of virtual curves on the other ones of the virtual inner shell model, the virtual outer shell model, and at least one of the at least one virtual intermediate level using the position of the first set of virtual curves, wherein each one of the virtual curves of the second sets corresponds to a respective one of the virtual curves of the first set. The step of generating virtual minimal surfaces in the internal volume includes using the virtual curves of the first set and the second sets.

In some embodiments, each one of the virtual curves of the second sets corresponding to a respective one of the virtual curves of the first set define a curve alignment which extends substantially normal to a junction with the virtual inner shell model.

In some embodiments, generating virtual minimal surfaces includes defining a virtual 3D structure inside the internal volume following the virtual minimal surfaces.

In some embodiments, positioning virtual curves on the virtual inner shell model and the virtual outer shell model includes distributing the virtual curves to prevent virtual curve intersection.

In some embodiments, generating virtual minimal surfaces includes steps of: associating a periodic waveform to each one of the virtual curves; and generating the virtual minimal surfaces between adjacent ones of the waveforms.

In some embodiments, generating virtual minimal surfaces includes: generating a gyroid between the virtual inner shell model and the virtual outer shell model; and deforming the generated gyroid using the virtual curves.

In some embodiments, generating virtual minimal surfaces includes selecting a thickness of the virtual minimal surfaces.

In some embodiments, providing the virtual inner and outer shell models includes selecting a thickness of the internal volume and positioning the virtual outer shell model with respect to the virtual inner shell model in accordance with the selected thickness of the internal volume.

In some embodiments, the process includes positioning virtual throughout apertures in at least one of the virtual inner shell model and the virtual outer shell model.

In some embodiments, providing the virtual inner and outer shell models includes selecting a virtual inner shell model having an internal contact surface sized and configured to substantially conform to at least a portion of an outer surface of a specific human head portion.

In some embodiments, the process includes dividing the helmet into a plurality of helmet portions and carrying out the process for designing the virtual helmet model for at least two of the helmet portions.

In some embodiments, the process includes combining the virtual helmet models of the at least two of the helmet portions.

In accordance with another aspect, there is provided a process for manufacturing a helmet. The process includes a step of conceiving the virtual helmet model using the process described above and a step of additive manufacturing the at least a portion of the helmet including an inner shell, an outer shell, and the shock absorbing layer between the outer and the inner shells, wherein the shock absorbing layer maintains the outer shell spaced-apart from the inner shell.

In some embodiments, additive manufacturing includes additive manufacturing the inner shell, the outer shell, and the shock absorbing layer as a single piece.

In some embodiments, the helmet is divided into a plurality of helmet portions and additive manufacturing includes additive manufacturing at least two of the helmet portions using a respective one of the virtual helmet model and securing together the at least two helmet portions.

In some embodiments, the shock absorbing layer includes a plurality of periodic and interconnected surfaces.

In accordance with another aspect, there is provided a helmet engageable with a human head portion conceived by the process described above.

In accordance with another aspect, there is provided a method for conceiving a 3D model of a custom helmet engageable with a specific human head portion to cover and protect an outer surface thereof. The method includes the steps of: obtaining a plurality of head measurements points indicative of a shape of the outer surface of the specific human head portion; designing an internal contact surface of an inner shell using the plurality of head measurements points, the internal contact surface being based on the plurality of measurement points to substantially conform to at least a portion of the outer surface of the specific human head portion; positioning an outer shell at a distance from the internal contact surface to define an internal volume between the internal contact surface and an inside surface of the outer shell; and filling the internal volume with a 3D closed volumetric mesh defining a plurality of interrelated polyhedral microstructures to obtain the 3D model of the custom helmet.

In an embodiment, filing the internal volume comprises projecting lines outwardly from the plurality of head measurements points to the inside surface of the outer shell of the 3D model to obtain a plurality of outwardly extending projecting lines extending from the internal contact surface and further comprises positioning the 3D closed volumetric mesh based on the plurality of outwardly extending projecting lines.

In an embodiment, the method further comprises selecting a convex polyhedral object having a basic shape and a basic size and filing the internal volume further comprises interconnecting a plurality of the convex polyhedral object to form the 3D closed volumetric mesh filing the internal volume and further comprises stretching and/or compressing at least one of the plurality of interconnected convex polyhedral objects to fill the internal volume.

In an embodiment, stretching and/or compressing at least one of the plurality of interconnected convex polyhedral objects to fill the internal volume is performed by at least one of polygonal modeling, curve modeling, sub-d polygonal modeling, NURBS modeling, and digital sculpting.

In an embodiment, filing the internal volume further comprises positioning additional design points on the internal contact surface of the inner shell of the 3D model and projecting lines outwardly therefrom to the inside surface of the outer shell of the 3D model to obtain additional outwardly extending projecting lines, and positioning the 3D closed volumetric mesh comprises positioning the 3D closed volumetric mesh based on the additional outwardly extending projecting lines.

In an embodiment, the head measurement points and/or the additional design points are substantially equidistant from one another.

In an embodiment, the internal contact surface intersects with the plurality of measurement points.

In accordance with another aspect, there is provided a method for manufacturing a custom helmet engageable with a specific human head portion to cover and protect an outer surface thereof. The method comprises the steps of: conceiving a 3D model of the custom helmet according to the method defined herein; and printing the 3D model to obtain the custom helmet.

In accordance with another aspect, there is provided a custom helmet engageable with a specific human head portion to cover and protect an outer surface thereof. The custom helmet comprises an inner shell comprising an internal contact surface being based on a plurality of head measurement points indicative of a shape of the specific human head portion and substantially conforming to at least a portion of the outer shape of the specific human head portion; an outer shell comprising an inside surface facing the inner shell, the outer shell being positioned at a distance from the inner shell and defining an internal volume between the internal contact surface of the inner shell and the inside surface of the outer shell; and a 3D closed volumetric mesh defined by a plurality of interrelated polyhedral microstructures, the 3D closed volumetric mesh filling the internal volume between the internal contact surface of the inner shell and the internal surface of the outer shell; wherein each one of the plurality of interrelated polyhedral microstructures is sized and shaped to enable the 3D closed volumetric mesh to absorb a given impact.

In an embodiment, the inner shell and/or the outer shell comprises a plurality of through holes.

In accordance with another aspect, there is provided a custom helmet engageable with a specific human head portion to protect an outer surface thereof conceived by the method as defined herein.

In accordance with another aspect, there is provided a helmet engageable with a human head portion. The helmet comprises an inner shell comprising an internal contact surface substantially conforming to at least a portion of an outer shape of the human head portion; an outer shell comprising an inner surface facing the inner shell and an outwardly facing surface, the outer shell being positioned at a distance from the inner shell and defining an internal volume between the inner shell and the inner surface of the outer shell; and a shock absorbing layer located between the inner and outer shells, the shock absorbing layer comprising a 3D closed volumetric mesh made from a 3D-printed material and defined by a plurality of interrelated polyhedral microstructures, the 3D closed volumetric mesh filling the internal volume between the internal contact surface of the inner shell and the internal surface of the outer shell.

In an embodiment, the 3D closed volumetric mesh comprises at least two rows of the polyhedral microstructures.

In an embodiment, the polyhedral microstructures are made of a plurality of interconnected rods.

In accordance with another aspect, there is provided a method for manufacturing a helmet. The method comprises the steps of: providing an inner shell having an internal contact surface substantially conforming to at least a portion of a human head portion; and an outer shell having an internal surface facing the inner shell and an outwardly facing surface, the inner and outer shells having respective sizes; forming a shock absorbing layer by printing a 3D closed volumetric mesh defining a plurality of interrelated polyhedral microstructures, an outer contour of the 3D closed volumetric mesh being function of the respective sizes of the inner and outer shells; and securing the shock absorbing layer between inner and outer shells of the helmet.

In accordance with another aspect, there is provided a method for conceiving a 3D model of a helmet engageable with a specific human head portion to cover and protect an outer surface thereof. The method comprises the steps of: selecting an inner shell having an internal contact surface sized and configured to substantially conform to at least a portion of the outer surface of the specific human head portion; positioning an outer shell at a distance from the internal contact surface to define an internal volume between the internal contact surface and an inside surface of the outer shell; and filling the internal volume with a 3D closed volumetric mesh defining a plurality of interrelated polyhedral microstructures to obtain the 3D model of the helmet.

In accordance with another aspect, there is provided a method for manufacturing a helmet engageable with a specific human head portion to cover and protect an outer surface thereof. The method comprises the steps of: conceiving a 3D model of the custom helmet according to the method defined herein; and printing the 3D model to obtain the custom helmet.

Other features and advantages of the invention will be better understood upon reading of embodiments thereof with reference to the appended drawings.

DETAILED DESCRIPTION

Figure 1A:
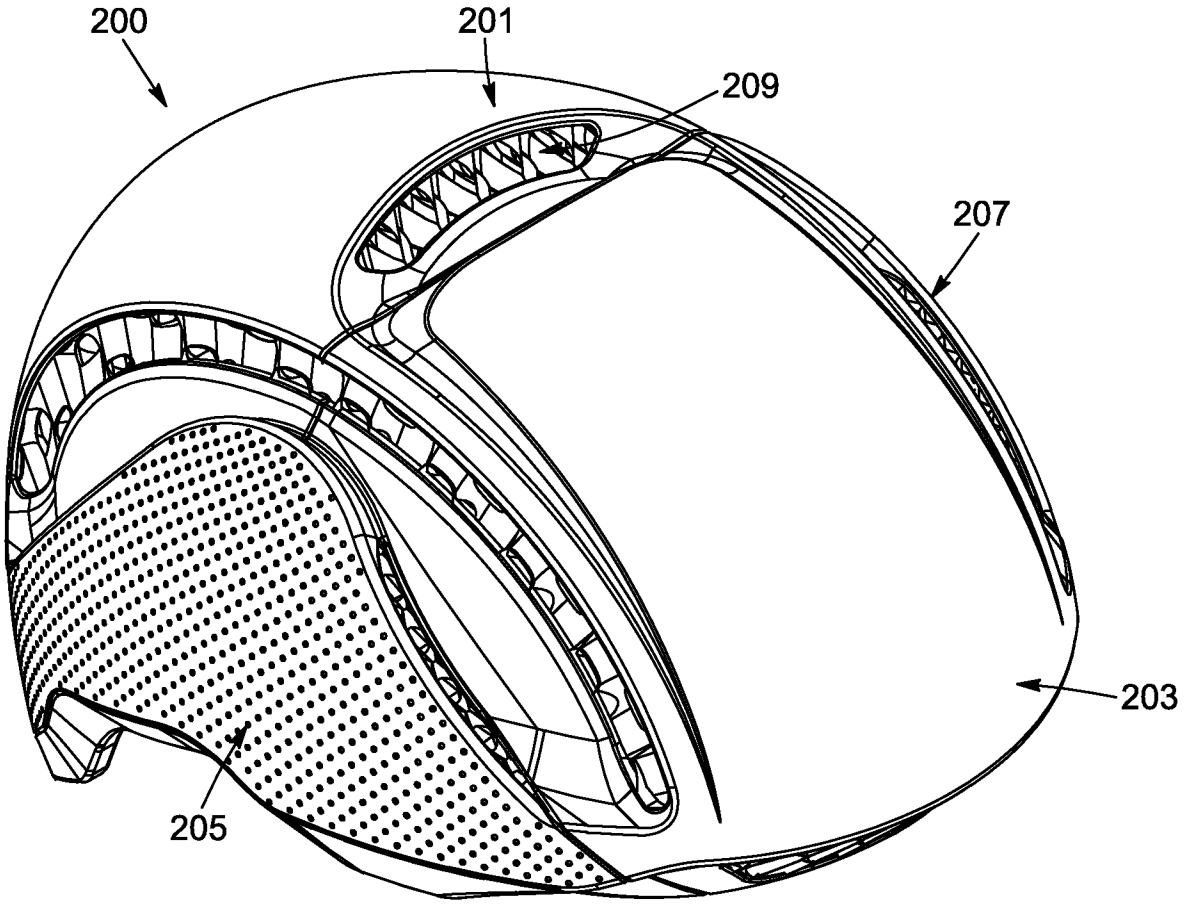
FIGS. 1A-B are perspective views of a helmet and the helmet divided in a plurality of engageable helmet portions, respectively, according to one embodiment.

In the following description, similar features in the drawings have been given similar reference numerals. In order to not unduly encumber the figures, some elements may not be indicated on some figures if they were already mentioned in preceding figures. It should also be understood herein that the elements of the drawings are not necessarily drawn to scale and that the emphasis is instead being placed upon clearly illustrating the elements and structures of the present embodiments.

Although the embodiments of the helmet and corresponding sections and/or parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the custom helmet, as will be briefly explained herein and as can be easily inferred herefrom by a person skilled in the art Moreover, it will be appreciated that positional descriptions such as "rear", "front", "left", "right", "upper", "lower", "outwardly", "inwardly", "outer", "inner" and the like should be taken in the context of the figures only and should not be considered limiting. Moreover, the figures are meant to be illustrative of certain characteristics of the custom helmet and are not necessarily to scale.

Helmet

Generally described, a helmet or at least a section of a helmet including a shock absorbing layer comprising at least one 3D structure is provided. The at least one 3D structure may be of different kinds, as it will be described in detail below, but is intended, when comprised within the helmet, to provide or enhance head protection for a user wearing the helmet when performing different activities, such as cycling, motorcycling, skiing, skating, skate boarding or any other sport for which a head protection from an impact may be required. The helmet could also be used in any application requiring a head protection such as, for instance and without being limitative, professional work or during transportation. As any helmet, the helmet which will be described is typically worn to cover an upper and outer surface (or regions near to the upper and/or outer surface) of a human head portion, and to attenuate or, in some cases resist a given impact upon, for example a collision with a hard structure (e.g. pavement, rock, ice, and the like), and so to reduce or protect the user against injuries from the collision. It is to be understood by the person skilled in the art that the helmet described herein has a shape similar to the helmets known in the art, i.e. the helmet generally covers the entire top portion of the wearer. It is however possible, in some cases that a helmet portion extending from the front to the rear wearer's head covers only one hemisphere thereof.

As will be described in more detail below, there is also provided a process for designing a virtual model of a helmet using a processor and a process for manufacturing a helmet based on the virtual model are provided. A helmet resulting from the designing and manufacturing processes is also provided.

Referring to FIGS. 1 to 6, an embodiment of a helmet 200 is shown.

The helmet 200 is configured to be engageable with a human head portion of a user and comprises an inner shell 202 with an internal surface 204 (sometimes also referred to as "an internal contact surface") that is configured to contact (or at least face) at least a section of the human head portion when the helmet is worn. The internal surface 204 is typically curved, but could also be, in some embodiments, at least partially flat in some region(s). The internal surface 204 defines a concavity of the helmet 200 to receive the wearer's head. The inner shell 202 also comprises an outer surface 216 extending outwardly from the internal contact surface 204.

As illustrated, the inner shell 202 is curved in shaped similar to the shape of a section of a sphere. In some embodiments, the inner shell 202 may be defined by a spherical cap (a "dome"), i.e. a portion of a sphere cut by a plane. Alternatively, the shape of the inner shell 202 could be different, and could be, for example, defined by a section of an ellipsoid, or any other customized or non-customized shapes which allow the inner shell to engage and, in some implementations, at least partially conform to a human head portion. It will be readily understood that the shape of the inner shell 202 may be shaped so as to accommodate the general shape of a transverse section of the human head, and so may have a substantially round or oval cross-section. It is to be noted that in the illustrated embodiment, the general shape of the internal surface 204 are substantially similar and substantially corresponds to the overall shape of the inner shell 202 and the outer surface 216.

In an embodiment, the inner shell 202 can be selected from a library of inner shells, wherein each one of the inner shells is characterized by a size, a curvature, a shape, a ventilation pattern, and the like. Alternatively, it can be at least partially or entirely customized to the wearer's head.

In an embodiment, the inner shell 202 is made of various types of material such as plastics. The plastics can be, for instance and without being limitative, polyethylene terephthalate (PET), polycarbonate (PC), acrylonitrile butadiene styrene acrylonitrile butadiene styrene (ABS), polyvinyl chloride (PVC), polylactic acid (PLA), polypropylene (PP), polyamide (e.g. nylon), polyurethane (PUR) fiberglass. Some of the plastics that may be used to form the inner shell 202 are compatible with additive manufacturing (i.e. 3D-printing).

In some embodiments, the inner shell 202 can include a plurality of throughout apertures 232, which can be of different size and shape and configured in accordance with any suitable pattern, provided to ensure proper ventilation of the human head. The throughout apertures 232 can facilitate evacuation of heat and/or humidity from the human head.

More particularly, the plurality of inner shell throughout apertures 232 may define an inner shell aeration pattern and can facilitate an evacuation of heat and/or humidity from the wearer's head. In an embodiment, some of the throughout apertures 232 may at least partially coincide with openings defined in a 3D structure, as will be introduced in more detail below.

As it will readily be understood by a person skilled in the art, cushion pads may be provided on a portion of the internal surface 204 of the inner shell 202 to improve a wear comfort of the helmet 200. The cushion pads can comprise for instance foam material or the like. In some embodiments, the cushion pads may be affixed with adhesives or with hook-and-loop fasteners, or with any other suitable fasteners. The cushion pads 209 can be provided on the inner shell 202 and/or the internal surface 204 of the inner shell 202. In some embodiments, the internal surface 204 may be at least partially covered by a protective layer (not shown). The protective layer can extend, for example, on a portion, or can even cover the entirety of the internal surface 204.

The helmet 200 further comprises an outer shell 206 comprising an inner surface 208. The inner surface 208 faces the outer surface 216 of the inner shell 202. The outer shell 206 also comprises an outwardly facing surface 210. As its name entails, the outwardly facing surface 210 is projecting outwardly from the helmet 200, and so is the surface of the helmet which is in contact with ambient air when the helmet 200 is worn by the user.

In an embodiment, the outer shell 206 has a predetermined curvature and shape. It can be selected from a library of outer shells 206, wherein each one of the outer shells is characterized by a size, a curvature, a shape, a ventilation pattern, a rib pattern, and the like. Alternatively, it can be at least partially or entirely custom designed.

In some implementations, the outwardly facing surface 210 of the outer shell 206 is an outmost surface. In other implementations, the outwardly facing surface 210 of the outer shell 206 may include a reinforcement layer and/or an aesthetic cover (not shown) positioned onto the outer shell 206

The outer shell 206 is positioned at a distance 212 from the inner shell 202. As such, the outer surface 216 of the inner shell is positioned to face the inner surface 208 of the outer shell 206. The outer surface 216 and the inner surface 208 defines an internal volume 214 between inner shell 202 and the outer shell 206.

In an embodiment, the distance 212 is predetermined. The distance 212 substantially correspond to a distance that is sufficient for the 3D structure 220 to fit therein, and more specifically, to fit 3D structure therein having required characteristics so that it can contribute to the shock attenuation properties of the custom helmet. On the other hand, the distance 212 can be a predetermined distance set according to safety standards, in which case the characteristics of the 3D structure 220 are adapted to provide adequate shock attenuation properties within the internal volume resulting from the predetermined distance. In an embodiment, the distance 212 can be between about between 5 to 100 mm, and, in an alternative embodiment, about 5 to 40 mm. In other embodiments, the distance 212 can be between about 5 to 25 mm.

In an embodiment, the distance between the internal surface 204 of the inner shell 202 and the internal surface 208 of the outer shell 206 can be variable. For instance, it can be thinner closer to the edges of the helmet 200 and thicker in the upper and rear portion to increase the shock attenuation properties. The distance can thus be determined at predetermined positions along the helmet 200 and can be adjusted in accordance with the shape and the curvature of the outer shell 206.

The inner shell 202 and/or the outer shell 206 can include a plurality of throughout apertures 234. In some embodiments, both the inner shell 202 and the outer shell 206 include throughout apertures 232, 234, respectively. In one embodiment, the throughout apertures 234 of the outer shell 206 can be smaller than the throughout apertures 232 of the inner shell 202, or vice-versa. The geometrical configurations (i.e. the shape, dimensions, aspect ratio) of such apertures 232, 234 can vary according to the positioning of the apertures 232, 234 on the helmet 200. The apertures 232, 234 could also be positioned to conform to a predetermined pattern, which can vary in accordance with the helmet design.

The thickness of the inner shell 202 and the outer shell 206 may vary according to different factors, such as sharp object impact protection, geometry fidelity trough usage, rules of material retraction regarding geometric intersections, comfort, optimal weight, additive manufacturing constraints. In some embodiments, the thickness of the inner shell 202 is between 0.3 and 3 mm, while the thickness of the outer shell 206 is between 0.5 to 5 mm. In the embodiment where the outer shell 206 includes a reinforcement layer, the thickness of the outer shell 206 can be chosen taking into consideration a thickness of the reinforcement layer, such that when both the outer shell 206 and the reinforcement layer are combined, a resulting thickness can contribute to the shock absorption characteristics of the helmet (and the shock absorbing layer, as it will be introduced further below). In another embodiment where the outer shell 206 is an aesthetic cover, the outer shell 206 may be a relatively thin decorative layer, and minimally contributes to the thickness of the outer shell 206.

The helmet 200 further comprises a shock absorbing layer 218 located between the inner shell 202 and the outer shell 206 within the internal volume 214. In some embodiments, the shock absorbing layer 218 is secured to at least one of the inner shell 202 and the outer shell 206. In one embodiment, the shock absorbing layer 218 is secured to the inner shell 202. In another embodiment, the shock absorbing layer 218 is secured to both the inner shell 202 and the outer shell 206.

In an embodiment, a portion of the shock absorbing layer 218 is exposed outwardly. Thus, even if the shock absorbing layer 218 typically refers to the layer comprised between the inner shell 202 and the outer shell 206, it is understood that, in some implementations, at least one portion of the shock absorbing layer 218 may be uncovered (i.e. not covered by the outer shell 206), and so portions of the shock absorbing layer 218 may be exposed. The shock absorbing layer 218 can be exposed through small or wide throughout apertures 234 defined in the outer shell 206, between the inner shell 202 and the outer shell 206, between adjacent portions of the helmet 200, as will be described in more detail below.

The shock absorbing layer 218 typically comprises at least one 3D structure 220 (also referred to as the "3D structure(s)"). The 3D structure(s) 220 occupy at least partially the internal volume 214 defined between the inner shell 202 and the outer shell 206.

In some embodiments, the 3D structure(s) 220 include a plurality of interconnected surfaces 222 (also referred to as "the interconnected surfaces"). The surfaces 222 are said to be interconnected because at least a portion of each surface is joined to an adjacent surface, i.e. physically connected surface. As such, the 3D structures 220 comprise interconnected surfaces 222 which have internal connections with one another, or connections with a portion of one another. In an embodiment, the 3D structure(s) 220 is single piece with the material thereof extending continuously between adjacent and interconnected surfaces 222

The 3D structures 220 may be, for example, embodied by a network of individual cells at least partially comprised (i.e. "sandwiched") between the inner shell 202 and/or outer shell 206. As illustrated, the network of individual cells forms a lattice structure, and each cell, defined by a respective portion of the interconnected surfaces 222, may be open and hollow, so as to form openings 224 therethrough. In some embodiments, the lattice structure may be formed by a repetition of one "primitive cell" along one or more direction so as to define layers 233. The expression "primitive cell" is herein understood as a minimal volume cell having translational symmetry in one or more axis. As such, the whole lattice structure may be described in relation with the primitive cell, or in some embodiments by the repetition of such primitive cell along one or more axes.

As illustrated, each layer 233 comprises contiguous and interconnected individual cells admitting at least one opening 224 therein. In some embodiments, the lattice defining the interconnected surfaces 220 is periodic along two axes, for example along the direction 226 and 228 defined in FIG. 7. In other embodiments, the lattice may be periodic along one, two, or three directions.

In an embodiment, the openings 224 defined in the shock absorbing layer 218 have a diameter ranging between 1 and 15 mm.

The shock absorbing layer may be divided into a plurality of superposed and connected layers 233. Each one of the illustrated layers 233 comprises a plurality of primitive cells, as it has been introduced above.

In one embodiment, the layers 233 are conforming to the outwardly facing surface 211 and are extending along the direction 226. In some embodiments, the layers 233 follow virtual spaced-apart curves extending substantially from one end of the helmet section to another end of the helmet section. Such virtual spaced-apart curves may serve as a template or a guide for the positioning of the interconnected surfaces 222 on the outer surface 216 of inner shell 202 during the designing process, as it will be described in another section. It will be readily understood that the terms "curved lines", "curves", and the like herein refer to a line conforming to (i.e. following) an area which can be curved or substantially spherical. If the curved lines are straight, they are characterized by a null (void) curvature. Otherwise, when they are curved they are characterized by a non-null curvature. In this context, the spaced-apart curves may also be referred to as "geodesic", i.e. the shortest way between two points on the curved or spherical area, or alternatively, a curve having tangent vectors that remain parallel if they are moved along the curve.

It is to be noted that the interconnected surfaces 222 may define minimal surfaces and that the minimal surfaces may be based on a gyroid, i.e. a triply periodic minimal surface, as it will be described in greater detail below.

The shock absorbing layer 218, and more particularly the 3D structures 220 may be made, in some embodiments, from a 3D-printed material. In one embodiment, the inner shell 202 and the outer shell 206 are made from a 3D-printed material, are further printed as a single piece with the shock absorbing layer 218. As such, at least a portion of the helmet 200, including at least portions of the inner shell, the outer shell, and the shock absorbing layer, could be formed from a monolithic 3D printed material.

In some embodiments, the shock absorbing layer 218 is configured so as to resist or protect against a given impact for e.g. the force of impact following a fall of a cyclist on a paved road, i.e. a fall of about 2 meters.

In some embodiments, the 3D structure 220 can be adapted in order to deform permanently upon a given impact or so that the 3D structure 220 regain their original shape after a shock attenuation, whether they are rigid or flexible.

Figure 1B:
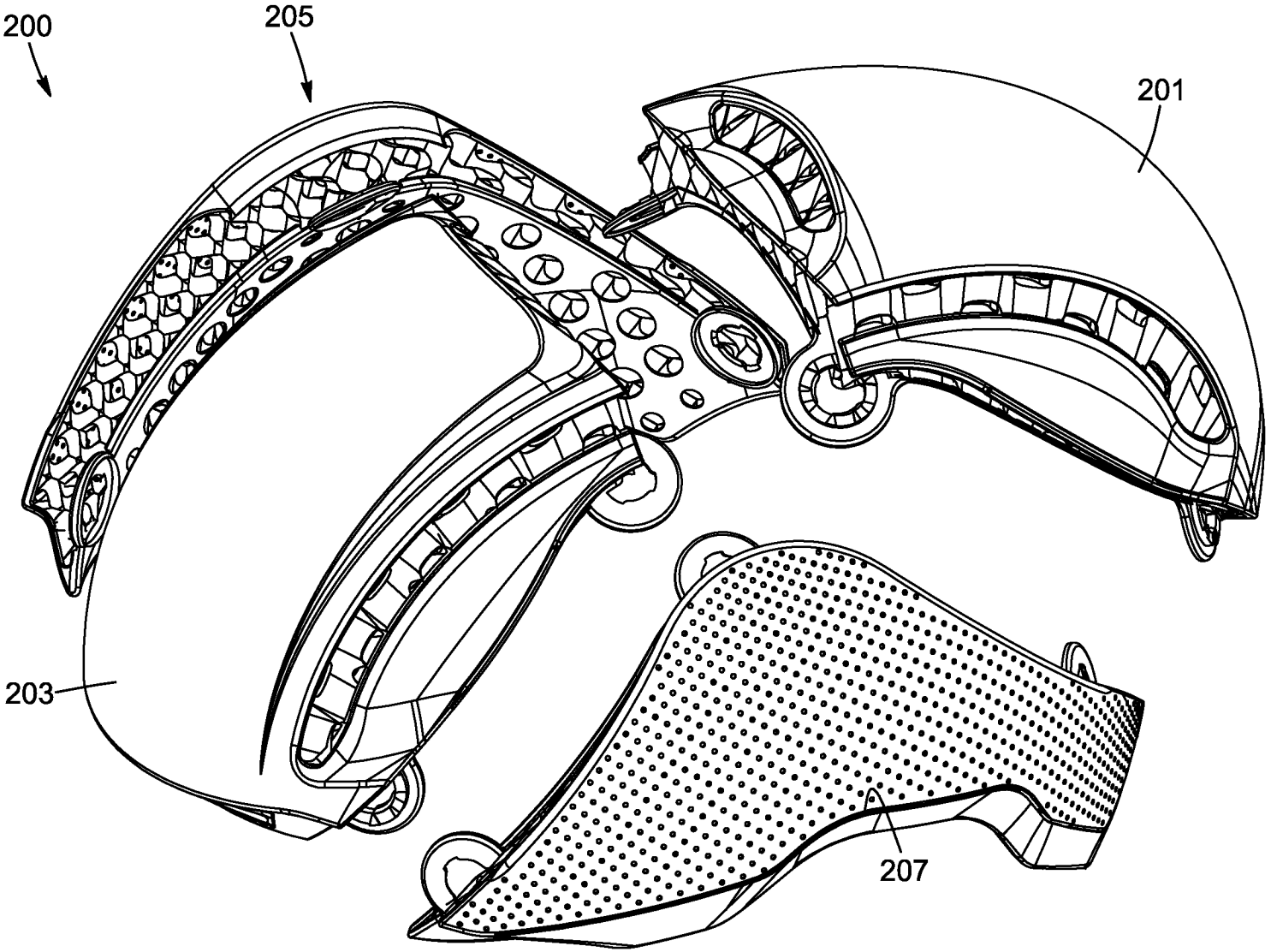
Figure 2:
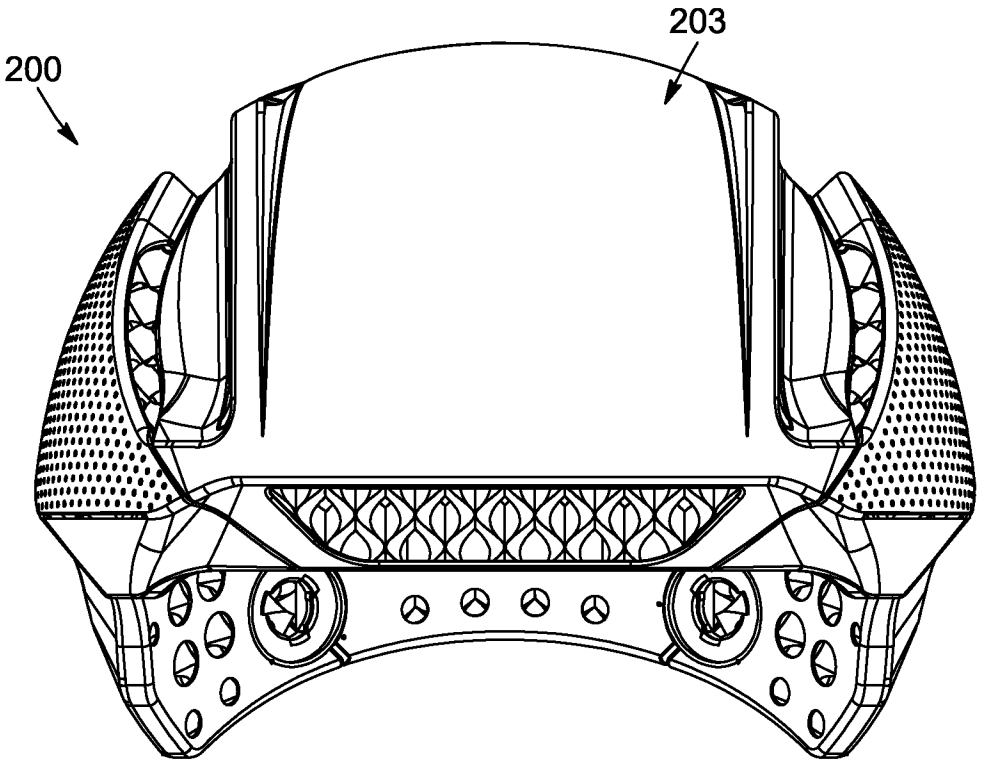
FIG. 2 is a front view of the helmet according to the embodiment of FIG. 1A.
Figure 3:
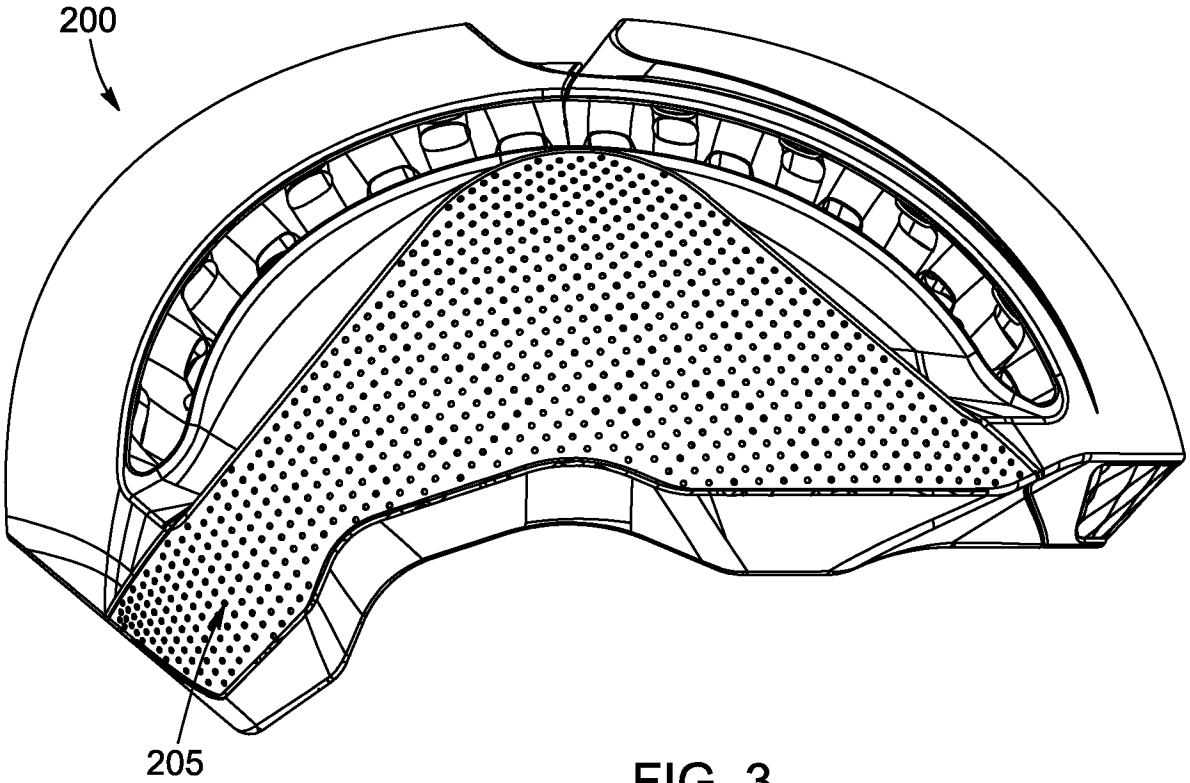
FIG. 3 is a right side view of the helmet according to the embodiment of FIG. 1A.
Figure 4:
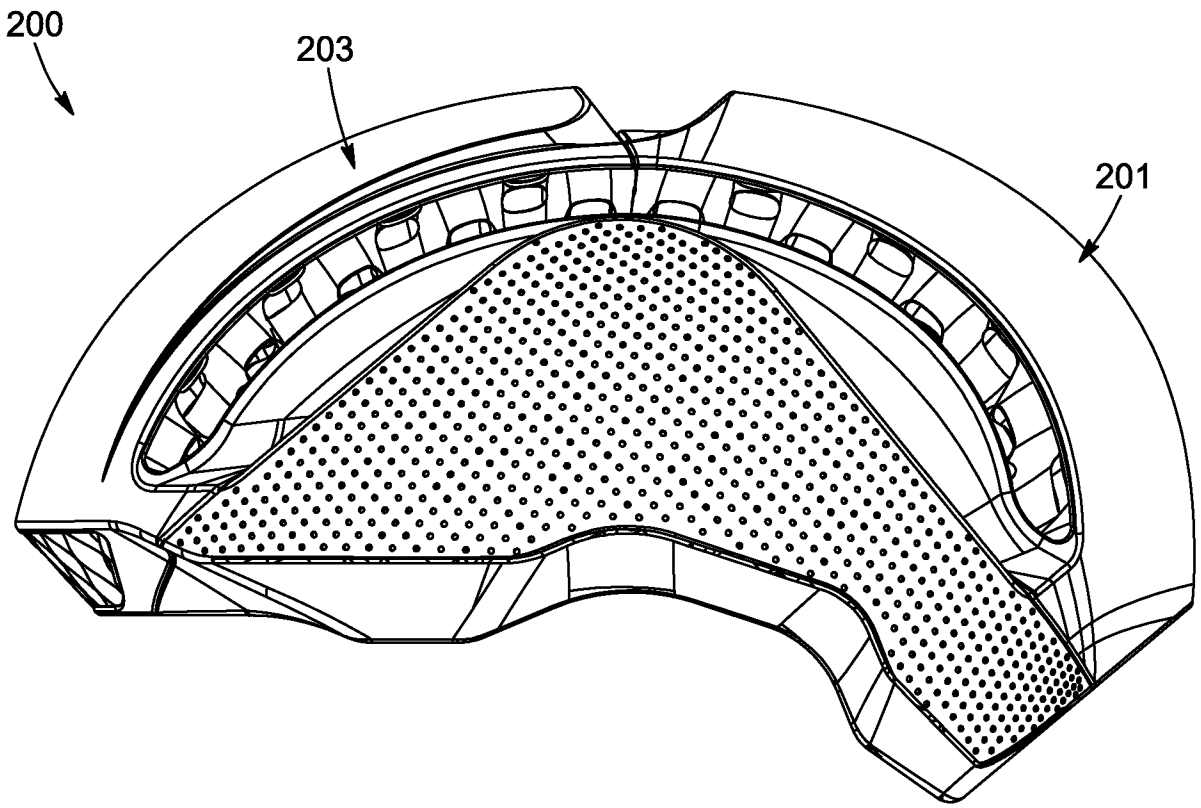
FIG. 4 is a left side view of the helmet according to the embodiment of FIG. 1A.
Figure 5:
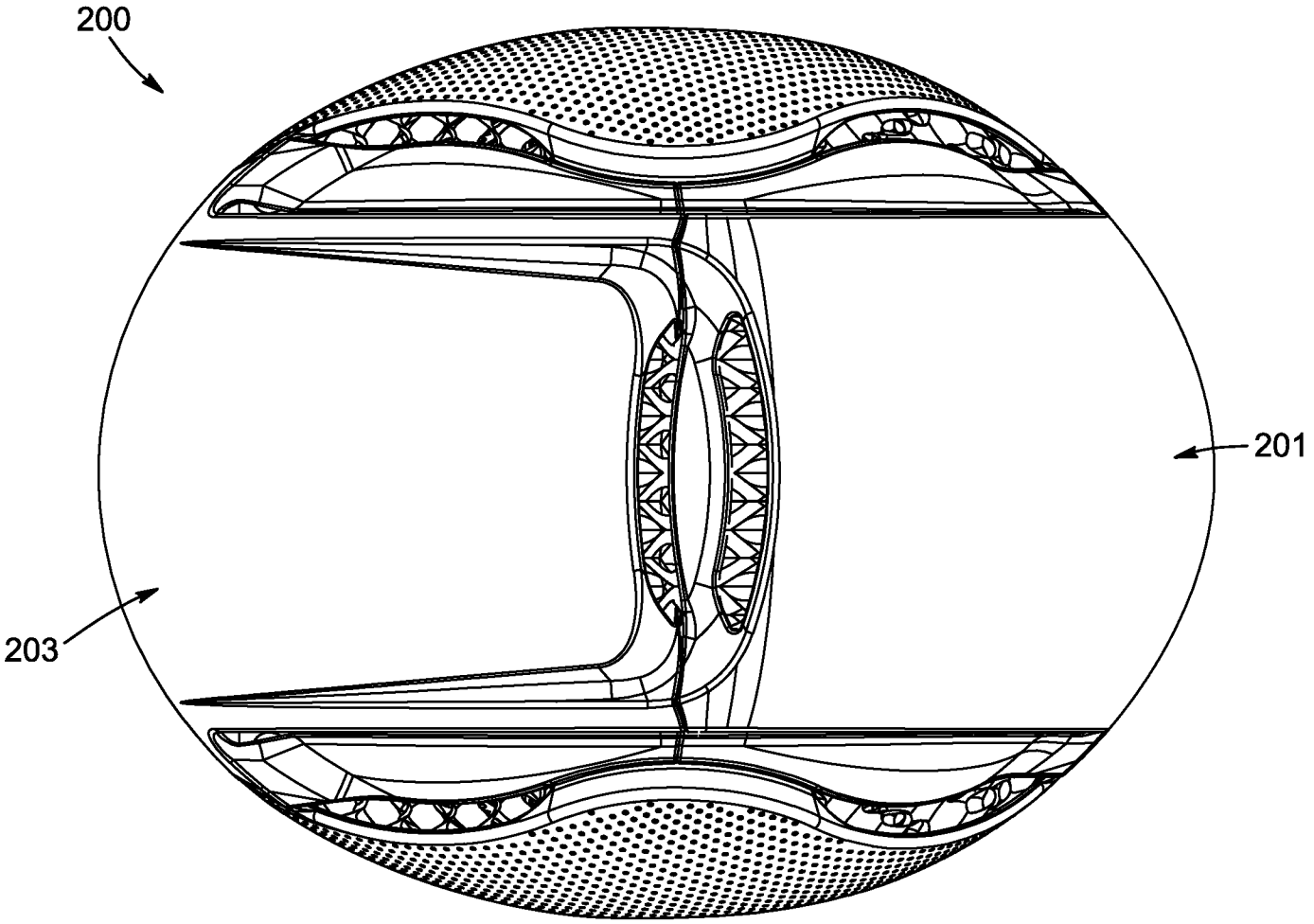
FIG. 5 is a top view of the helmet according to the embodiment of FIG. 1A.
Figure 6:
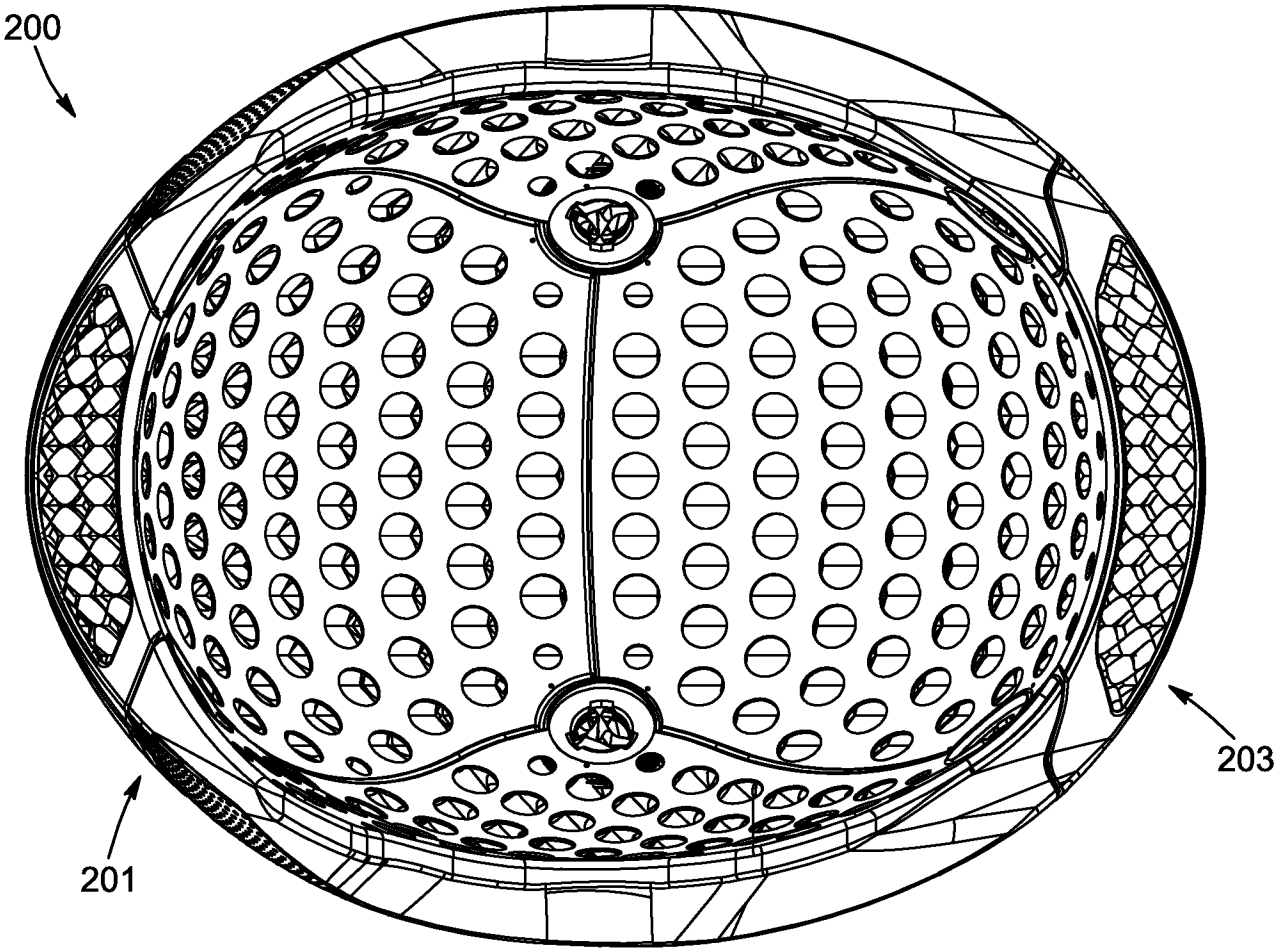
FIG. 6 is a bottom view of the helmet according to the embodiment of FIG. 1A.

In some embodiments, such as the one illustrated in FIG. 1B, the helmet 200 comprises a plurality of helmet portions secured together. As represented in FIG. 1, the helmet 200 can comprise, for instance, a rear portion 201, a front portion 203, a right portion 205 and a left portion 207. Typically, at least two of the helmet portions 201, 203, 205, 207 comprise a respective one of the inner shell 202, a respective one of the outer shell 206, and a respective one of the shock absorbing layer 218 extending between the respective ones of the inner and outer shells 202, 206. In some embodiments, every helmet portions 201, 203, 205, 207 may comprise a respective one of the inner shell, outer shell and shock absorbing layer. In such embodiments, each one of the section may be made from a 3D printed material. It will be readily understood that the description presented above for illustrating the possible embodiments, implementations and variants for the helmet as a whole may also apply to the helmet portions 201, 203, 205, 207.

Thus, in some embodiments, the helmet 200 may comprise at least two helmet portions and at least one of them can include the shock absorbing layer 218 including a 3D structure 220, as described above, at least partially sandwiched between the inner and the outer shells 202, 206. In an embodiment, at least one of the inner and the outer shells 202, 206 can extend along more than one helmet portion, sandwiching at least partially inbetween two or more shock absorbing layers. In another embodiment, one helmet portion can include its own inner and the outer shells 202, 206 at least partially sandwiching inbetween its shock absorbing layer.

The helmet portions (e.g. the helmet portions 201, 203, 205, 207) can include a similar or a different 3D structure, either in pattern, size, material, configuration, and the like.

The outline of adjacent helmet portions can be complementary in shape in a manner such than they can easily be secured together. Either on the inner or outer sides, the helmet can include another superficial layer to maintain the secured helmet portions together.

Optionally, in some implementations, the helmet 200 can include at least one ventilation opening/aperture (not shown). The at least one ventilation/aperture opening can be, for instance, a ventilation opening through the outer shell 206, which can allow cooling air to enter in the internal volume of the helmet 200 and circulate through the 3D structure 220 and reach a portion of the wearer's head through the plurality of inner shell throughout apertures 232. In other implementations, the at least one ventilation opening can also include a ventilation opening through the 3D structure 220, i.e. a discontinuity in the 3D structure defining the ventilation opening, the opening being sized and shaped to allow cooling air to contact the wearer's head. Similarly, in an embodiment, the inner shell 202 can also include a ventilation opening which can be in register, or substantially aligned, with the ventilation openings defined in the outer shell 206 and the 3D structure 220 to define the ventilation opening extending through the helmet 200. As it as been mentioned, the surface area of the ventilation opening(s) may be wider than the throughout apertures 232 provided in the inner shell 202.

Now referring to FIGS. 7 to 12, exemplary embodiments for the 3D structures will be presented and described in detail, into which is illustrated a helmet portion 209. The helmet portion 209 also comprises an inner shell 202, an outer shell 206, and a shock absorbing layer 218, such as the ones which have been previously described.

Helmet with 3D Structure(s) and Openings Oriented Along Two Non-Parallel Axes

The first embodiment relates to a helmet portion 209, minimally having 3D structures and openings which are oriented along two non-parallel axes to provide aeration therein.

Figure 7:
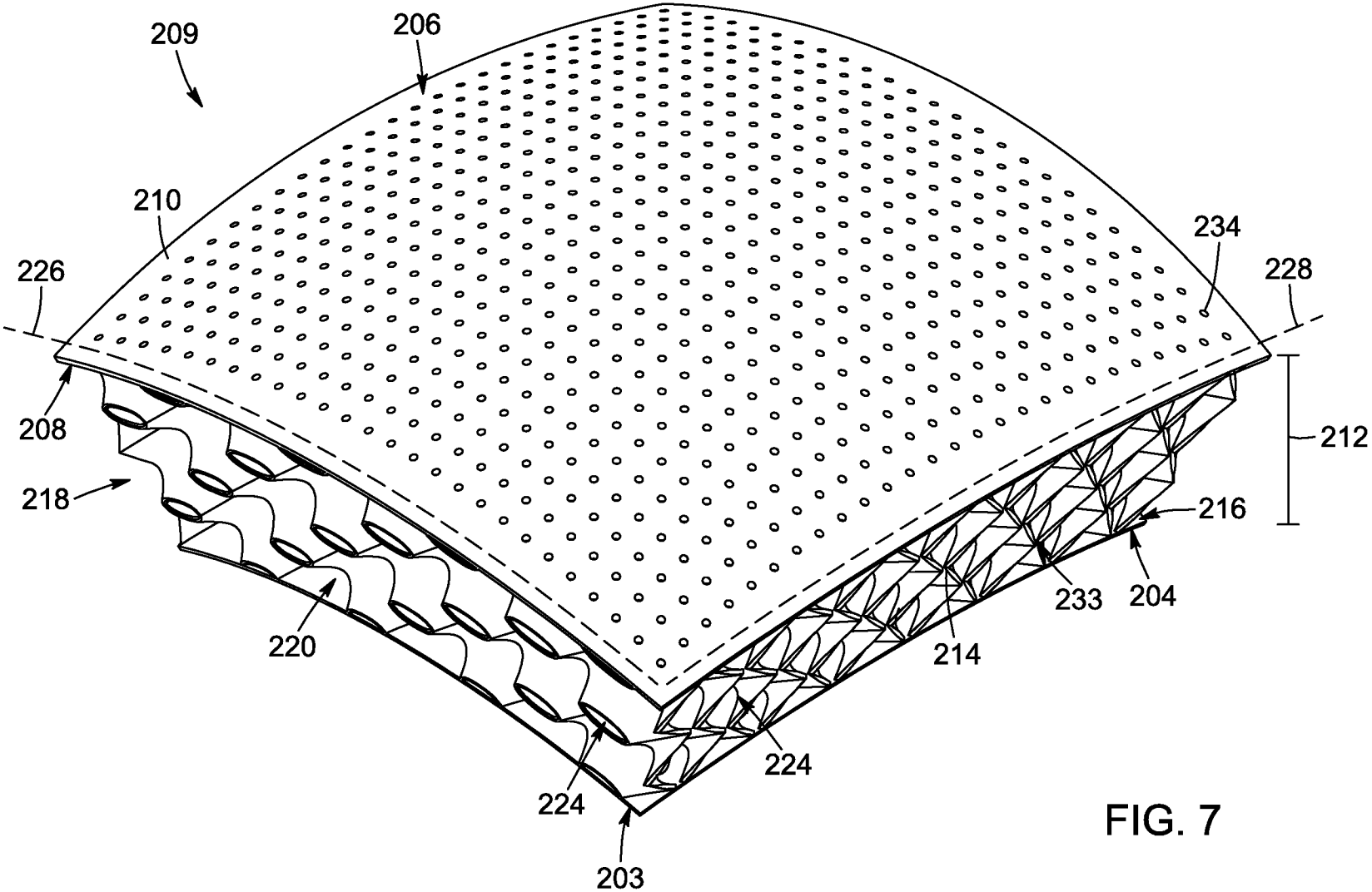
FIG. 7 is a top perspective view of a helmet portion according to an embodiment.
Figure 8:
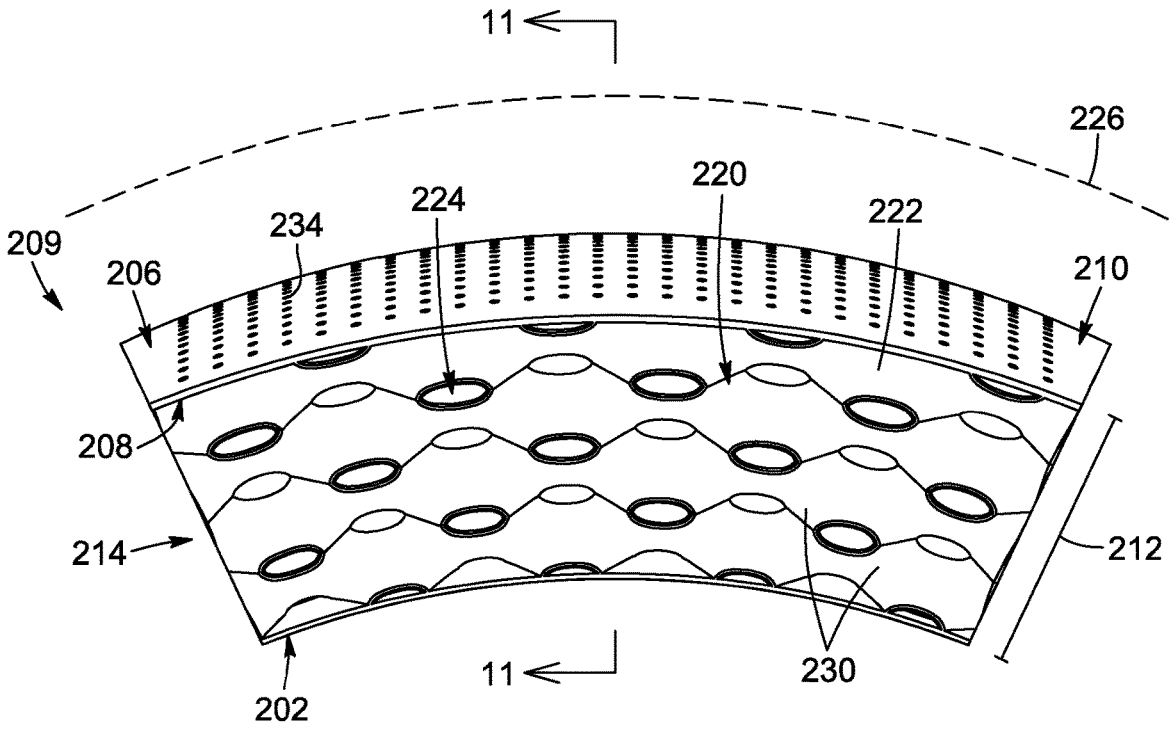
FIG. 8 is a side view of the helmet portion according to the embodiment of FIG. 7.
Figure 9:
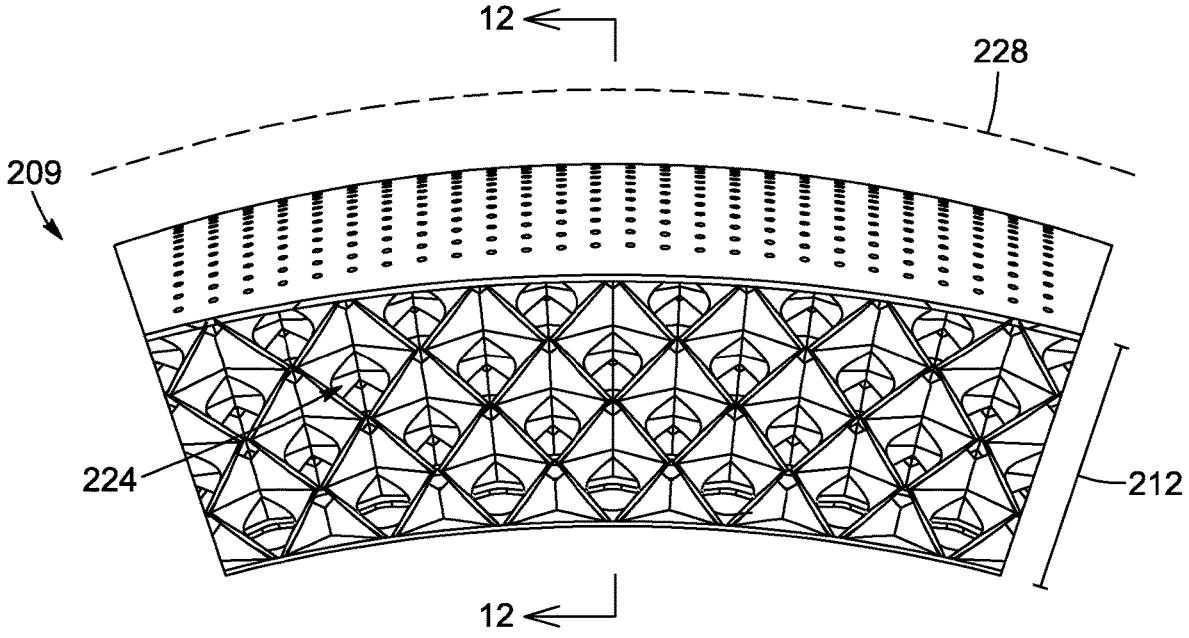
FIG. 9 is another side view of the helmet portion according to the embodiment of FIG. 7.

As illustrated in FIG. 7, the shock absorbing layer 218 comprises a 3D structure 220. As it has been previously introduced, the 3D structure 220 is defined by a plurality of interconnected surfaces 222 with a plurality of openings 224 (referred to as "openings") defined inbetween. The plurality of openings 224 define non-linear air circulation paths inside the shock absorbing layer 218, thereby promoting air circulation therein.

The openings 224 are, in this embodiment, oriented along at least two non-parallel axes to allow air circulation in the 3D structures 220 filling the internal volume 214 between the inner shell 202 and the inner surface 208 of the outer shell 206.

Figure 10:
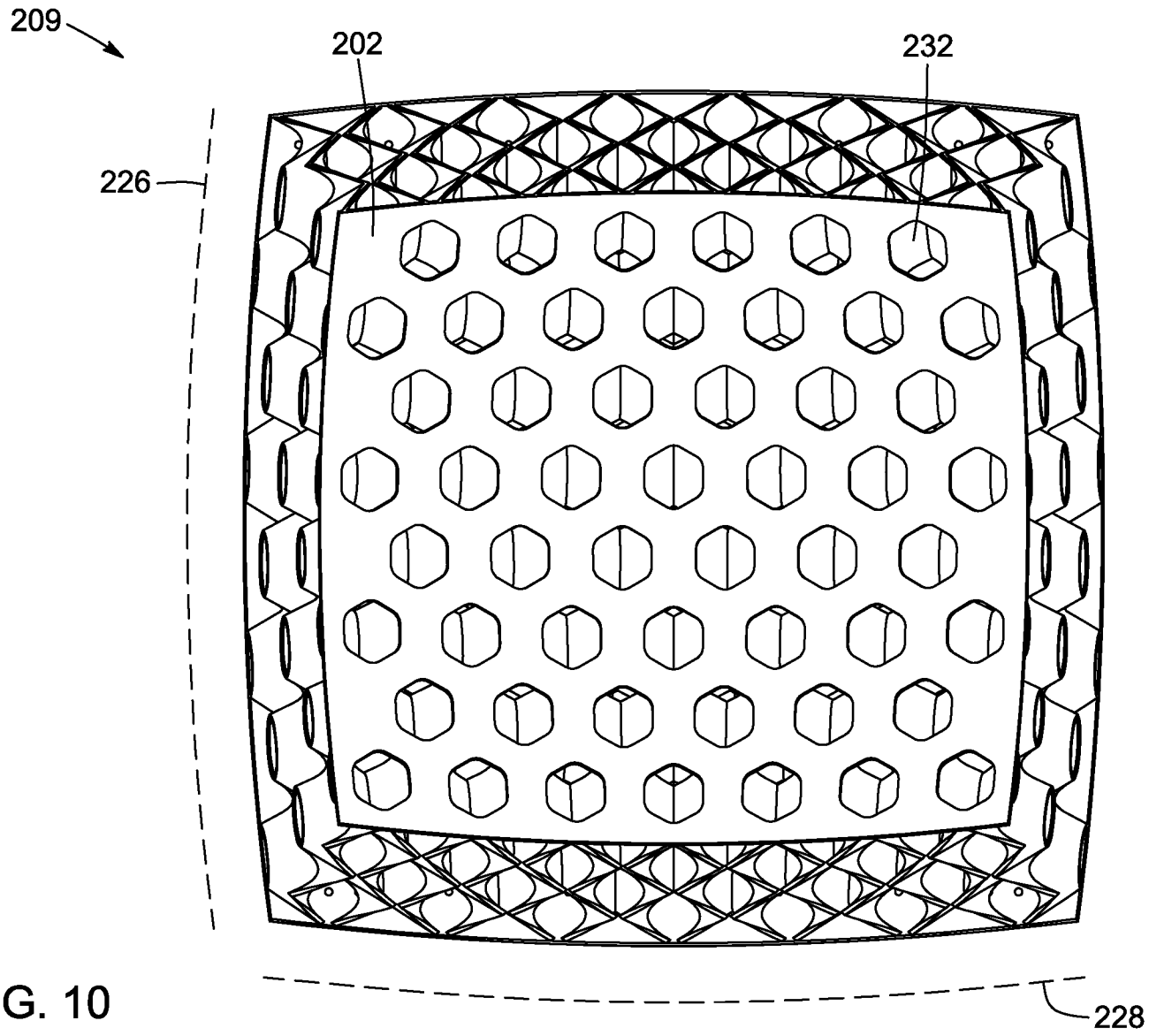
FIG. 10 is a bottom view of the helmet portion according to the embodiment of FIG. 7
Figure 11:
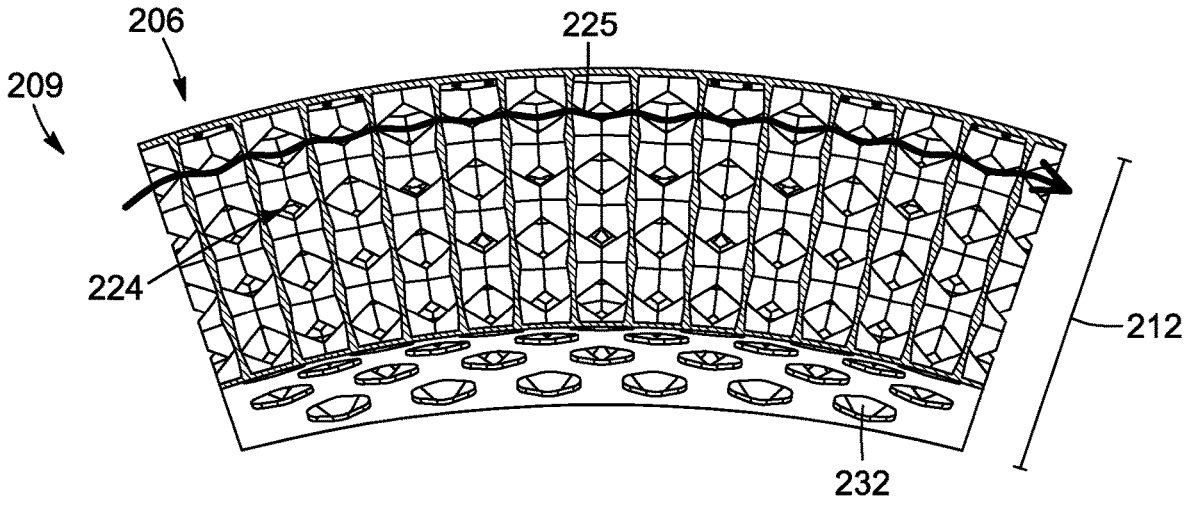
FIG. 11 shows a cross-sectional view of the helmet portion shown in FIG. 8.
Figure 12:
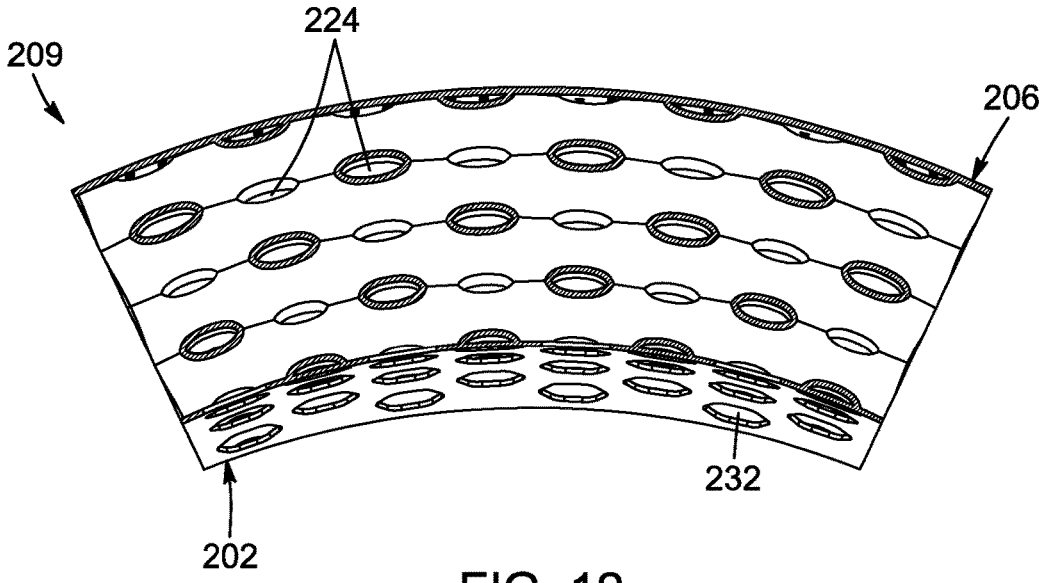
FIG. 12 shows a cross-sectional view of the helmet portion shown in FIG. 9.

As better seen in FIG. 10, the openings 224 may be defined between the interconnected surfaces 222 of the 3D structures 220 along two axes, exemplified by the longitudinal and transverse directions 226 and 228. The depicted embodiment shows that the longitudinal direction 226 may be normal to (i.e. may form an angle substantially equal to 90 degrees with) the transverse direction 228. Of course, the angle between longitudinal direction 226 and the transverse direction 228 may vary depending on different factors, such as, for example, the overall shape and/or the configuration of the 3D structures 220. In some embodiments, the openings 224 may extend along two directions that are not forming a right angle (e.g any angle comprised in the interval [0,180]

degrees). It will be readily understood that that the openings could be, in alternate embodiments be oriented along more than two axes, for example and without being limitative, three, four, five or more non-parallel axes.

In this embodiment, the interconnected surfaces 222 may define a 3D periodic pattern.

The characteristics of 3D structures 220 may vary depending on the targeted application, and so the choice of materials, the thickness of the interconnected surfaces 222, and the general shape of the 3D structures 220 may also vary.

As it will be described in greater detail below with reference to the manufacturing process, the 3D structure made from a 3D-printed material is, in some embodiments obtained through additive manufacturing process. In the current description, the expression "3D printing" and "additive manufacturing" are used interchangeably.

Helmet with Minimal Surfaces

The second embodiment also relates to a helmet portion 209 having a 3D structure with and openings which are oriented along two non-parallel axes, but wherein the 3D structure design is based on minimal surfaces. In this sense, this embodiment can be seen as a variant of the embodiment presented in the preceding section.

More particularly, the helmet portion 209 according to this embodiment comprises a shock absorbing layer similar to what has been described so far, but differs from what has been previously introduced in that the 3D structure filing the internal volume between the inner shell and the outer shell is defined by a plurality of interconnected minimal surfaces 230 (referred to as "minimal surfaces").

The 3D structure 220 also at least partially fills the internal volume 214 between the inner shell 202 and the inner surface 208 of the outer shell and maintaining the outer shell spaced-apart from the inner shell.

The expression "minimal surfaces" is herein understood in its mathematical sense, and so refers to surfaces that locally minimize their area, or, alternatively, to surfaces that minimize total surface area under a given constraint. Broadly described, minimal surfaces are surfaces that have a zero-mean curvature. The expression encompasses a broad variety of surfaces, some of them being described in greater detail below. Non-limitative examples of minimal surfaces are catenoids, helicoids and gyroids.

In the context of the present description, the minimal surfaces 230 are periodic in at least one direction (or "axis"). In other embodiments, the minimal surfaces 230 may be doubly or even triply periodic, that is, the minimal surfaces 230 can comprise a repetition of a predetermined shape or pattern in two or three dimensions, respectively.

In this embodiment, the interconnected surfaces 220 previously described are based on minimal surfaces 230. In some implementation, the interconnected minimal surfaces 230 are based on a gyroid.

When the shock absorbing layer 218 comprises minimal surfaces 230, the 3D structure 220 may also be made from a 3D-printed material. In this embodiment, when the inner shell 202 and the outer shell 206 are made from a 3D-printed material, the inner shell 202 and the outer shell 206 may be printed as a single piece with the shock absorbing layer 218.

In some embodiments, stretching and compression of some of the interconnected surfaces 230 can be performed, for example close to an extremity (i.e. an end) of a helmet portion.

Similarly to the interconnected surfaces 222, the interconnected minimal surfaces 230 also define a plurality of openings 224 therein. The openings may be oriented along at least two non-parallel axes in a configuration similar to what has been said with respect with the previous embodiment.

In some embodiments, the openings 224 defined by the 3D structure 220 defines non-linear air circulation paths 225 to allow air circulation inside the shock absorbing layer 218.

The mechanical properties of the minimal surfaces 230 can be predetermined and adapted so as to be useful when used in the context of protect the head of a user. For example, and without being limitative, the elasticity and the strength (the resistance to an impact, for instance) of the minimal surfaces 230 can be adapted to meet certain safety and/or mechanical requirements.

Helmet with Periodic Structures

In a third embodiment, the 3D structure 220 is not defined by a plurality of interconnected minimal surfaces 230, but rather by a repetition of a shape, structure, or pattern along one or more directions ("axes"). In this context, the 3D structure 220 may be defined by a repetition of a primitive cell, as it as been previously described. In the context of this embodiment, the primitive cell will be referred to as a periodic structure.

Non-limitative examples of such periodic structures include the repetition of a parallelepiped (that may or may not have orthogonal angles, equal lengths, or both), different prisms, polytopes or variants thereof (e.g. a truncated parallelepiped, truncated prism or truncated polytopes).

In one alternate embodiment, the 3D structure may be embodied by a concave cavity forming an alveolar structure (i.e. resembling an alveolar structure).

The periodic can define a plurality of openings therein. Such openings may be oriented along at least two non-parallel axes in a configuration similar to what has been said with respect with the previous embodiment. Alternatively, the openings defined by the periodic can define non-linear air circulation paths to allow air circulation inside the shock absorbing layer 218.

Process for Designing a Virtual Helmet Model

In accordance with another aspect, the process for designing a virtual helmet model will be described.

Broadly described, the process for designing a virtual helmet model (also referred to as "the designing process") uses a processor. More particularly, one or more step(s) of the designing process can be implemented in computer programs executing on programmable computers, each comprising at least one processor, a data storage system (i.e. a memory including, for example and without being limitative, volatile and non-volatile memory and/or other storage elements), at least one input device, and at least one output device. The input device can be adapted and configured to interact with the processor(s) and/or the data storage system, while the output device can be configured to display information or signals (e.g. the virtual helmet model, or portions thereof) sent from the processor and/or the memory.

It will be readily understood that, in some implementations, the programmable computer may be a programmable logic unit, a mainframe computer, server, and personal computer, cloud based program or system, laptop, personal data assistance, cellular telephone, smartphone, wearable device, tablet device, virtual reality devices, smart display devices (ex: Smart TVs), set-top box, video game console, portable video game devices, or virtual reality device.

Each computer program can be implemented in a high level procedural or object-oriented programming and/or scripting language to communicate with a computer system, as briefly described above. However, the programs can be implemented in assembly or machine language. In any case, the language may be a compiled or interpreted language. Each such computer program can be stored on a storage media or a device readable by a general or special purpose programmable computer for configuring and operating the computer when the storage media or device is read by the computer to perform the steps and processes described herein. In some embodiments, the systems may be embedded within an operating system running on the programmable computer, such as the ones already known in the art.

As previously mentioned, the virtual helmet model is representative of at least a portion of the helmet. In some embodiments, the helmet can be divided into helmet portions, and so the designing process or step(s) of the designing process can be adapted for designing a virtual helmet portion(s) model.

Figure 13:
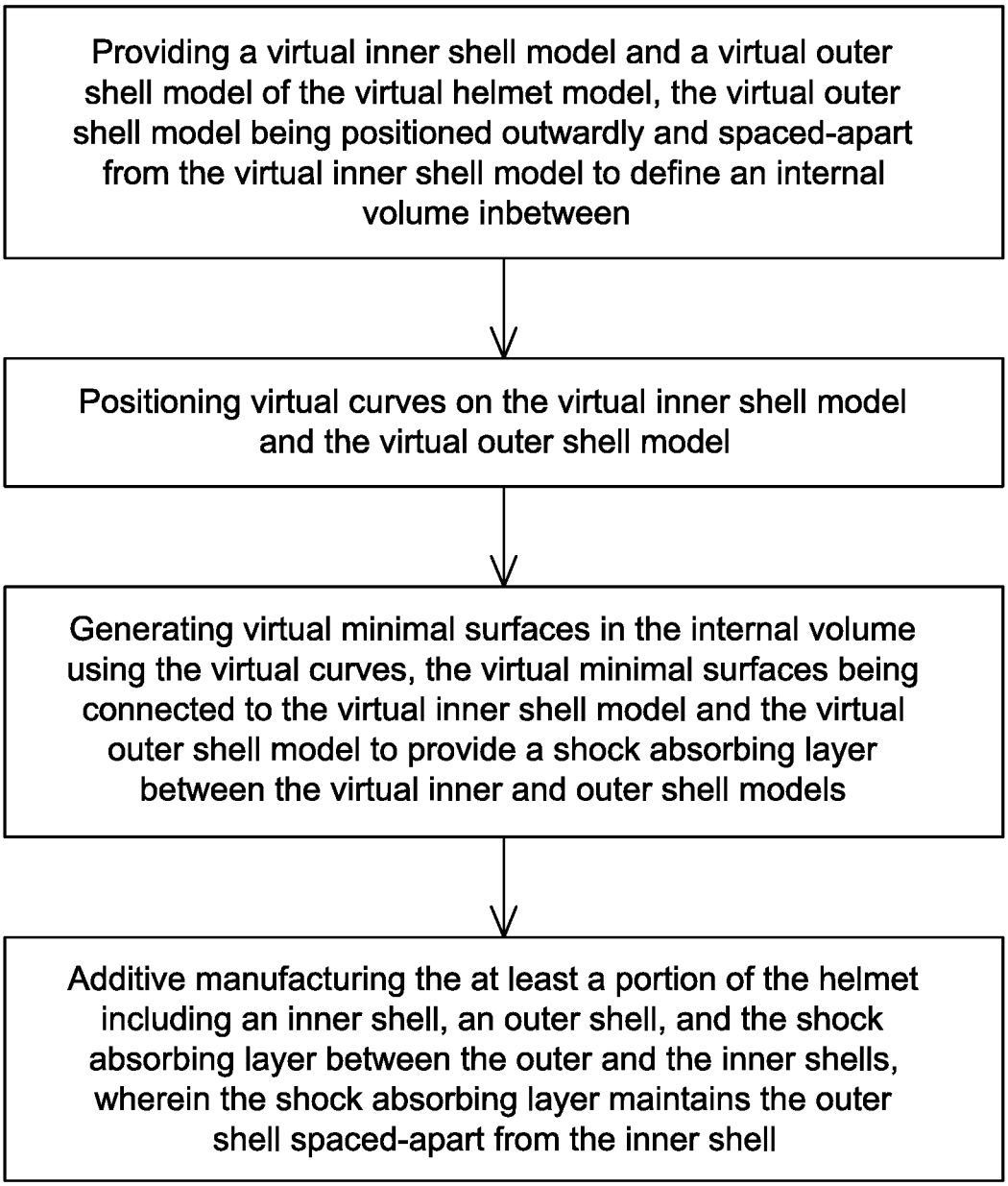
FIG. 13 is a schematic diagram of a process for designing a virtual helmet model and a process for manufacturing a helmet, according to a possible embodiment.

Referring to FIG. 13, the designing process comprises the steps of providing virtual inner shell and virtual outer shell models, positioning virtual curve(s) on the virtual inner and outer shell models and generating virtual minimal surfaces. Each one of these steps will now be described in greater detail.

Providing Virtual Inner Shell and Virtual Outer Shell Models

Referring to FIGS. 14A-E, a virtual inner shell model 302 and a virtual outer shell model 306 of a virtual helmet portion model are provided. In this step, the virtual outer shell model 306 is positioned outwardly while remaining spaced-apart from the virtual inner shell model 302 to define an internal volume inbetween.

In some embodiments, providing the virtual inner and outer shell models 302, 306 may comprise further steps of selecting a thickness of the internal volume and positioning the virtual outer shell model 306 with respect to the virtual inner shell model 302 to respect the selected thickness of the internal volume.

The step of selecting the virtual inner shell model 302 can be carried to as the virtual inner shell model 302 has an internal contact surface that is at the same time sized and configured to substantially conform to at least a portion of an outer surface of a human head portion, and in some embodiments, to an upper human head portion.

The inner and outer shell models 302, 306 can be designed custom or selected from an existing library. In some embodiments, the step of providing the virtual inner and outer shell models 302, 306 can include a step of selecting their thickness. In an embodiment, the thickness of the virtual inner and outer shell models 302, 306 may be substantially the same or similar, while, in another embodiment, their thickness is different. The inner and outer shell models 302, 306 can be flat or have a curvature. In some scenarios, the inner and/or outer shell model(s) 302, 306 can be flat, but their final curvature may be predetermined.

In some embodiments, the outer shell model 302 and the inner shell model 306 have substantially the same surface area. In other embodiments, the distance between the outer and inner shell models 302, 306 can be variable at different positions, i.e. some sections can be closer to one another while other can be further spaced-apart.

Figure 14A:
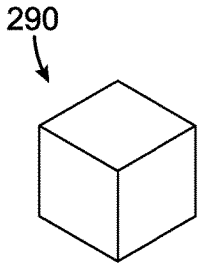
FIGS. 14A-E illustrate a step providing a virtual inner shell model and a virtual outer shell model of a virtual helmet model representative of at least a portion of a helmet, according to one embodiment.
Figure 14B:
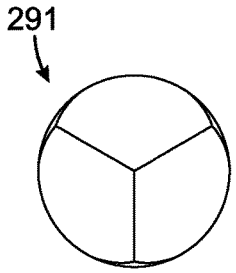
Figure 14C:
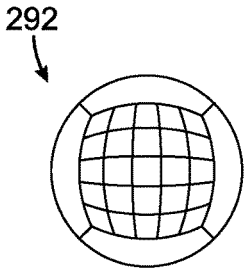
Figure 14D:
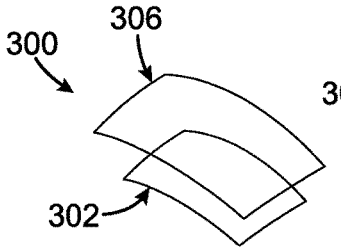
Figure 14E:
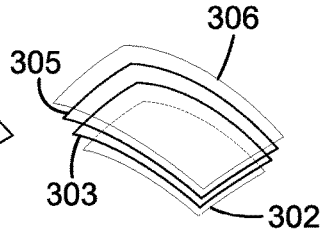
Figure 15A:
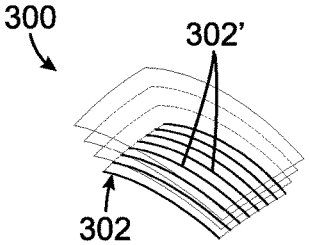
FIGS. 15A-15D illustrate a step of positioning virtual curves on the virtual inner shell model, the virtual outer shell model and intermediate levels model, according to one embodiment.
Figure 15B:
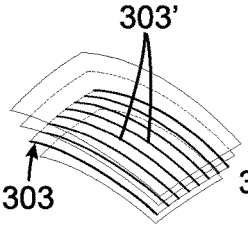
Figure 15C:
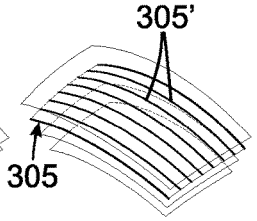
Figure 15D:
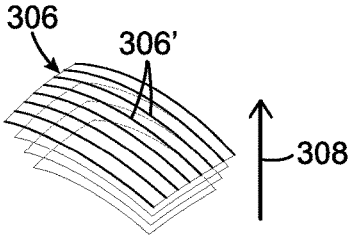

In some embodiments, for example illustrated in FIG. 14B, one or more (i.e. at least one) virtual intermediate layer model can be provided. In the exemplary embodiment of FIG. 14B, two virtual intermediate layer models 303, 305 (corresponding to a first and second virtual intermediate level models) are provided, between the virtual inner and outer shell models 302, 306. As such, the virtual helmet portion model comprises four virtual levels, namely the virtual inner shell, the first intermediate level, the second intermediate level, and the outer shell models 302, 303, 305, 306, respectively, with layers defined inbetween adjacent ones of the levels. The virtual intermediate levels 303, 305 can have a surface area substantially similar to the surface area of the virtual inner and outer shell models 302, 306. Alternatively, the surface area of at least one of the virtual intermediate level models 303, 305 can be different of the remaining ones of the virtual level model(s) 303, 305 and/or virtual inner/outer shell models 302, 306. In the embodiment shown, the thickness of the layers, i.e. the spacing between adjacent ones of the levels, is substantially identical. However, in an alternative embodiment, it is appreciated that the thickness of different layers can be variable. It will be readily understood that the number of virtual intermediate level(s) provided, as well as the different geometrical configurations of each one of the virtual intermediate level(s) can vary according to different factors, such as, and without being limitative, to meet specific design and/or safety requirements.

In some embodiments, and now referring to FIGS. 14-E, the step of providing a virtual inner shell and outer shell models 302, 306 can comprise using a quad-ball (also referred to as a "sphere"). In such embodiments, a step of defining an origin of the virtual helmet model (or virtual helmet portion model) is carried out, followed by a step of positioning at least two intersecting planes about the origin. In the illustrated embodiments, six intersecting planes are obtained so as to form a cube 290. The at least two intersecting planes define at least one intersecting line. As illustrated, the six intersecting planes define twelve (12) edges of the cube 290. The at least one intersecting line (i.e. the twelve edges of the cube 290 in the illustrated embodiment) is then projected onto the quad-ball 291. The intersecting lines (or the edges) define a surface portion 292 that is representative of at least a portion of the virtual inner shell model 302 and/or virtual outer shell model 306, when the intersecting line(s) is(are) projected onto the quad-ball 291. It will be readily understood that while the at least two intersecting planes are illustrated as being six square facets of a cube in the FIGS. 14A, the number of planes, as well as their shape and dimensions, can vary according to the helmet or helmet portion being designed.

Positioning Virtual Curve on the Virtual Inner Shell and Virtual Outer Shell Models The designing process also comprises a step of positioning virtual curves on the virtual inner shell model 302, the virtual outer shell model 306 or one of the intermediate level models 303, 305 (if any). In some embodiments, the virtual curves are spaced-apart from one another.

For example, and now referring to FIGS. 15A to 15D, the step of positioning the virtual curves on the virtual inner shell model 302 and the virtual outer shell model 306 may comprise a step of positioning a first set of virtual curves (e.g. the curves 302') on one of the virtual inner shell model, the virtual outer shell model (e.g. the virtual inner shell model 302), and one of the intermediate level models 303, 305 (if any). This step may be followed by a step of positioning second set(s) of virtual curves (e.g. 306') on the other ones of the virtual inner shell model 302, the virtual outer shell model 306 (e.g. the virtual outer shell model 306), and the intermediate level models 303, 305 (if any) using the position of the first set of virtual curves (e.g. the curves 302'). In this scenario, each one of the virtual curves 306' of the second set(s) corresponds to a respective one of the virtual curves 302' of the first set. Alternatively, the curves 302', 306' can be provided in pairs, i.e. one of the curves 302' can be positioned on the virtual inner shell model 302 while one the curves 306' is simultaneously positioned on the virtual outer shell model 306, or groups if intermediate level models 303, 305 are provided.

In some implementations, each one of the virtual curves of the second set(s) (e.g. 306') corresponding to a respective one of the virtual curves of the first set (e.g. 302') define a curve alignment (e.g. a curve alignment direction or axis 308).

In an implementation, the curve alignment extends substantially normal to a junction with the virtual inner shell model 302. In this implementation, the virtual curves 306' positioned on the outer shell 306 can be said to be vertically aligned with the virtual curves 302' positioned on the inner shell 302. Alternatively, the curve alignment direction axis can form an angle with the virtual inner shell model 302 that is different than a right angle, so as the virtual curves 306' positioned on the outer shell 306 are offset (i.e. are not vertically aligned) with the virtual curves 302' of the inner shell 302. For example, the virtual curves 306' can be staggered with respect to the virtual curves 302'.

In some embodiments, the virtual curves 302' and 306' extend from one extremity to another of a corresponding one of the virtual inner and outer shell models 302, 306 and the intermediate level models 303, 305 (if any). It would be readily that the virtual curves 302', 306' can extend along only a portion or several portions of the corresponding one of the virtual inner and outer shell models 302, 306 and the intermediate level models 303, 305 (if any). Also, the specific characteristics (e.g. length, direction, positioning) of each of the virtual curves 302', 306' can be the same or different, and can be dictated by design and/or safety requirements.

In some scenarios, positioning virtual curves (e.g. 302' and/or 306') on the virtual inner shell model 302, the virtual outer shell model 306 and the intermediate level models 303, 305 (if any) includes a step of distributing the virtual curves to prevent virtual curve intersection. As illustrated in FIGS. 15A-15D, the virtual curves 302' and 306' can extend substantially parallel to one another and follow the curvature of the inner and/or outer shell models 302, 306 onto which they are positioned. Thus, the virtual curves 302' and/or 306' do not intersect with adjacent ones. Alternatively, the virtual curves 302' and 306' can be respectively positioned on the inner shell and outer shell models 302, 306 so as they converge, meet or are tangential at least at one point. In such alternatives, the virtual curves 302' and/or 306' are not parallel, and the distance between each one of the virtual curves 302' and/or can vary along a direction of the inner and/or outer shell models 302, 306.

The inner and/or outer shell models 302, 306 can be characterized by a curved surface. In such implementation, the virtual curves (e.g. 302' and/or 306') that are positioned on the outer and/or inner shell models 302, 306 have also a non-null curvature. More particularly, the curvature of the virtual curves can be substantially the same as the outer and inner shell models 302, 306. Alternatively, the inner and outer shell models 302, 306 can be flat (i.e. having a null-curvature). In this implementation, the virtual curves positioned on the inner and outer shell models 302, 306 are characterized by a virtual curve of null-curvature, i.e. a straight line.

Generating Virtual Minimal Surfaces

The process also comprises a step of generating virtual minimal surfaces in the virtual internal volume (defined by the virtual inner and outer shell models 302, 306) by the using the virtual curves (e.g. 302', 303', 305' and/or 308').

Exemplary embodiments of the virtual minimal surfaces 310, 311, 312, 313 are illustrated in FIGS. 17A-17D. The virtual minimal surfaces 310-313 are connected to the virtual inner shell model 302 and the virtual outer shell model 306, and so provide a virtual shock absorbing layer between the virtual inner and outer shell models 302, 306.

In some embodiments, the step of generating virtual minimal surfaces can comprise defining a virtual 3D structure(s) inside the internal volume following the virtual minimal surfaces. The virtual 3D structure(s) are representative of the 3D structure 220 which has been described with respect to the helmet 200 and helmet portion 209.

Figure 16A:
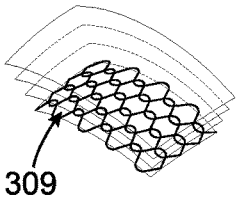
FIGS. 16A-16D illustrate a step of associating a waveform to each of the virtual curves of the virtual inner shell model, the virtual outer shell model and the intermediate levels, according to one embodiment.
Figure 16B:
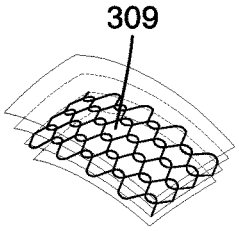
Figure 16C:
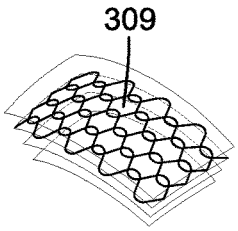
Figure 16D:
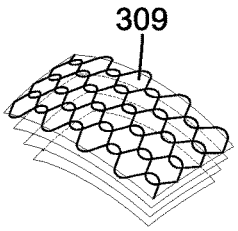
Figure 17A:
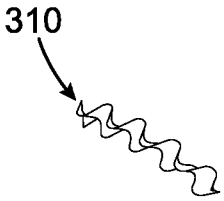
FIGS. 17A-17D illustrate a step of generating virtual minimal surfaces using the virtual curves, according to one embodiment.
Figure 17B:
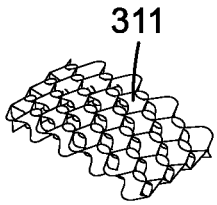
Figure 17C:
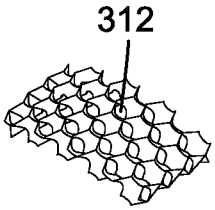
Figure 17D:
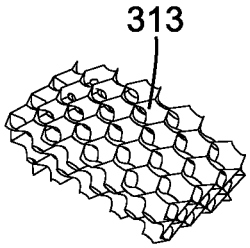

In some embodiments, as the ones illustrated in FIGS. 16A-B, the step of generating virtual minimal surfaces comprises steps of associating a waveform 309 to each one of the virtual curves (e.g. the virtual curves 302',303',305', 306' provided on a corresponding one of the virtual inner shell, first intermediate level, second intermediate level and outer shell models 302, 303, 305, 306). In this context, the virtual minimal surfaces 310-313 can be generated between adjacent ones of the waveforms 309. In an embodiment, the waveform 309 is periodic, and so will be referred to as the periodic waveform 309 in the following. In some implementations, the waveform 309 associated to each one of the virtual curves 302',303',305', 306' is the same, but it will be readily that, in other implementation, the waveform can differ from one virtual level to the others. As such, the waveform associated with the virtual curves 302' can be different the waveform associated with the virtual curves 303', as it will be further described below.

The term "periodic waveform", previously introduced generally refers to periodic signal oscillating about a given line (also referred to as "zero axis point"). In the context of the step of generating the virtual minimal surfaces, the waveform 309 refers to a general shape of a cross-section of the interconnected surfaces 222 taken along the directions 226, 228 (i.e. in the plane defined by directions 226, 228), and may oscillate about a respective one of the curves 302', 303' 305', 306'. Simply put, the waveform 309 may be a single line pattern defining a 2D shape (e.g. a sawtooth function or a sine function). In some scenario, this 2D shape is periodic. It is to be noted that the waveform 309 can be, but is not necessarily curvilinear. Adjacent waveforms 309 can be aligned, intercalated or offset with respect to one another. When the adjacent waveforms 309 are aligned, the respective peaks (or, alternatively the "local maximum", i.e. the higher point in a determined neighbourhood) of each of the adjacent waveforms 309 are aligned (i.e. the peaks are placed one vis-à-vis another). When the adjacent waveforms 309 are offset, the peak (or the local maximum) of one of the waveforms is aligned with a trough (or the local minimum) of the other one of the waveforms, and so the peaks (or local maximum) of the waveforms are spaced-apart, and can be, in some scenario, intercalated along one direction (e.g. the direction 236).

Examples of waveforms 309 encompass, but are not limited to sine wave, cosine wave, other trigonometric wave (e.g. tangent, cotangent, secant, cosecant, any other trigonometric functions, basis function or combinations thereof), curved wave (e.g. curvilinear wave), periodic wave, complex wave, triangular wave, square wave, or combinations thereof. The waveforms could either be periodic or aperiodic. In the case of periodic waveforms, the waveforms 309 can be simple (e.g. by a single sinewave) or complex (e.g. represented by a sum of sinewave). In the case of aperiodic waveforms can either be continuous or having the form of a pulse. In some embodiments, the waveforms can be periodic and simple along at least one axis.

In one alternative embodiment, instead of using waveforms applied to the virtual curves, the step of generating virtual minimal surfaces comprises a step of generating a gyroid between the virtual inner shell model 302 and the virtual outer shell model 306. In this embodiment, a step of deforming the generated gyroid using the virtual curves is also carried out. In this implementation, the virtual inner and outer shell models 302, 306 can provided as planar. Therefore, the virtual curves 302', 306' positioned on the virtual inner and outer shell models 302, 306 have, in this context a null curvature. The inner shell and outer shell models 302, 306 can be obtained in a subsequent step of deforming the generated gyroid using the virtual curves 302', 306'.

It is to be noted that the step of generating minimal surfaces can also be adapted to comprise steps of providing planar inner and outer shell models, generating minimal surfaces and deforming the generated minimal surfaces.

During the step of generating the virtual minimal surfaces, it may be possible to select a thickness of the virtual minimal surfaces, so as, for example, meet specific requirements. The thickness and other geometrical characteristics of the minimal surfaces can be predetermined or selected from a library.

Figure 18A:
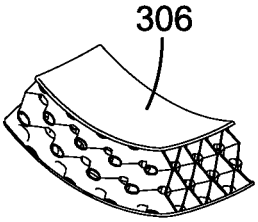
FIGS. 18A-18B illustrate a step of forming virtual throughout apertures on the inner shell model, according to one embodiment.
Figure 18B:
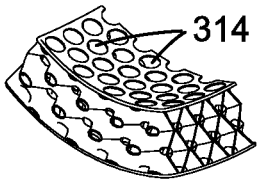

As illustrated in FIGS. 18A-B, the process can comprise a step of positioning virtual throughout apertures 314 in at least one of the virtual inner shell model and the virtual outer shell model (e.g. the virtual inner shell model 302).

Figure 19A:
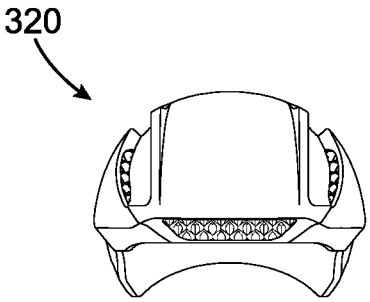
FIGS. 19A-19B illustrate a virtual helmet model, according to one embodiment.
Figure 19B:
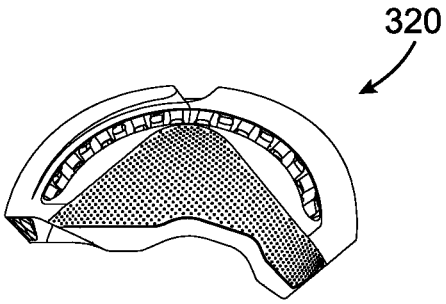

The process may further comprise a step of combining at least two virtual helmet portion models to obtain a virtual helmet model 320, such as the one illustrated in FIG. 19A-B.

Process for Manufacturing a Helmet

A process for manufacturing (also referred to as "a manufacturing process") a helmet or a helmet portion (if the helmet is divided into a plurality of helmet portions) is also provided. The manufactured helmet or the manufactured helmet portion is, in some embodiments, based on the virtual helmet model or the virtual helmet portion model obtained from the designing process (i.e. designed), which has been described in detail above. Hence, the manufacturing process can comprise, in some embodiments, a first general step of designing and conceiving the virtual helmet model or the virtual helmet portion model using at least one of the steps of the designing process as described in the previous section. While, in general, the manufacturing process comprises a step of conceiving the virtual helmet model (or the virtual helmet portion model) using the designing process described above, the manufacturing process could also, in an alternative embodiment, being with a step of importing a virtual helmet model or a virtual helmet portion model. In such an alternative embodiment, the virtual helmet model or the virtual helmet portion model can be designed according to another designing process. In some embodiments, for example, the virtual helmet model or the virtual helmet portion model can be selected at least partially or entirely from a library of existing virtual models, wherein each one of the virtual models are characterized by different features, such as their size, shape, and other relevant characteristics which have been previously introduced in the present disclosure. Alternatively, the virtual helmet model or the virtual helmet portion model can further be customized or at least adapted to the meet specific requirements, once imported from the library.

Once the virtual helmet (or helmet portion) model has been conceived or imported, a step of additive manufacturing is carried out. This step is carried out to additive manufacture the inner shell 202, the outer shell 206, and/or the shock absorbing layer 218 of the helmet 200 or at least one the helmet potion (e.g. at least one of the rear, front, right and left helmet portion(s) 201, 203, 205, 207, respectively).

In the current description, the expression "additive manufacturing" refers to methods, process and tools used for manufacturing 3D objects, but could also encompass the designing and or modeling steps carried out prior the manufacturing, some of them being already known by one skilled in the art. More specifically, the expression "additive manufacturing", also referred to as "3D printing", encompasses a broad spectrum of methods, such as, but not limited to binder jetting, directed energy deposition, material extrusion, material jetting, powder bed fusion, sheet lamination, vat photopolymerization, combinations thereof, or any other method(s) available to one skilled in the art.

In one embodiment, the additive manufacturing step is carried out using selective laser sintering (also referred to as "SLS"). SLS is a technique using a laser to selectively and locally sinter powder material provided as particles in a powder bed. The laser is then used to scan a surface (i.e. a cross-section) of the power bed according to a model (e.g. the virtual helmet or helmet portion model), so as the particles of the powder material fuse/sinter altogether after being exposed to the beam of the laser. After the completion of the scan of the surface (i.e. the cross-section) of the powder bed, a new layer of powder material can be applied on top. In such scenario, the process is repeated until the additive manufacturing of the helmet or the helmet portion is complete. The SLS technique can be used with different materials, such as plastics, polymers, ceramics, metals, and alloys. It will be readily understood by one skilled in the art that the implementation of the SLS technique can comprise the selection of the material to be used and appropriate post-treatment of the helmet or helmet portion (i.e. once the additive manufacturing step is completed), but also the selection of the laser source, (e.g. the laser source can be continuous or pulsed and operate at predetermined wavelengths. Alternatively, other 3D printing method(s) or processes could be carried out to achieve the additive manufacturing step.

For example, the additive manufacturing step can be carried out using multi-jet fusion techniques and methods, such as and without being limitative, HP® Multi Jet fusion. In such a process, a liquid bonding agent is selectively deposited on the surface of the powder material, according to a model (e.g. the virtual helmet or helmet portion model). Such process can be combined with a thermal source (e.g. a heat lamp) to facilitate penetration of the liquid bonding agent and/or the sintering/fusing of the particles of powder material. It would be readily understood that post-treatments can be applied. Such post-treatments can be carried out, for example and without being limitative, so as the surface of the manufactured helmet or helmet portion is sandblasted, smoothed, colored, painted, varnished, covered and/or coated.

As it has been briefly introduced, a processor or a computer may be used for designing the virtual helmet or helmet portion model. The additive manufacturing step is carried out with a 3D printer, which can be "local", i.e. operatively connected to at least one of the processor (or computer), input device and input device, or in a remote location, i.e. accessible through a network. In some embodiments, the 3D printer can be operatively connected to the processor (or computer), input device and output device via any suitable communications channel. For example, the 3D printer can communicate over a network that is a local area network (LAN or Intranet) or using an external network, such as, the Internet. In such implementation, the processor (or computer) and the 3D printer are operable to receive electronic transmissions from each other. More specifically, the virtual model (of the helmet or helmet portion) may be stored directly on the processor (or computer), devices thereof, or can be networked-based or cloud-based server.

In the embodiments wherein the helmet is be divided into helmet portions, the additive manufacturing step can be adapted for additive manufacturing a virtual helmet portion(s) to be later assembled to form the helmet, In some embodiments, the entire helmet 200 or helmet portion(s) (e.g. portions 201, 203, 205, 207) are formed as single piece helmet or single piece helmet section. In such embodiments, the step of additive manufacturing includes continuously additive manufacturing the inner shell 202, the outer shell 206, and the shock absorbing layer 218 as a single piece.

The result of the manufacturing process described above is a helmet or helmet portion(s) engageable with at least a human portion, in accordance with what has been described above. In some embodiments, wherein the interconnected surfaces 222 are not minimal surfaces, the manufacturing process can comprise a step of 3D printing a plurality of periodic and interconnected surfaces to form the shock absorbing layer 218.

It will be readily understood that the helmet or the helmet portion(s) may be conceived, designed and manufactured according to at least one of the embodiments of the designing and manufacturing processes described above. In some implementations, the helmet may be designed and manufactured according to a combination of some of the steps of at least one of the designing and manufacturing processes. More particularly, it is appreciated that features of one of the above described embodiments can be combined with the other embodiments, variants or alternatives thereof.

Custom Helmet Implementation

In general terms, the custom helmet implementation concerns a custom helmet engageable with a specific human head portion. The characteristics of the custom helmet described herein are made possible, amongst others, by the conceiving method used to design it. In particular, the conceiving method includes steps such as taking into consideration measurements of the specific human head portion, and designing a 3D model of the helmet based on these measurements. Having discussed the general context of the custom helmet, optional embodiments will be discussed further hereinbelow. The embodiments according to the following description are given for exemplification purposes only.

Figure 22:
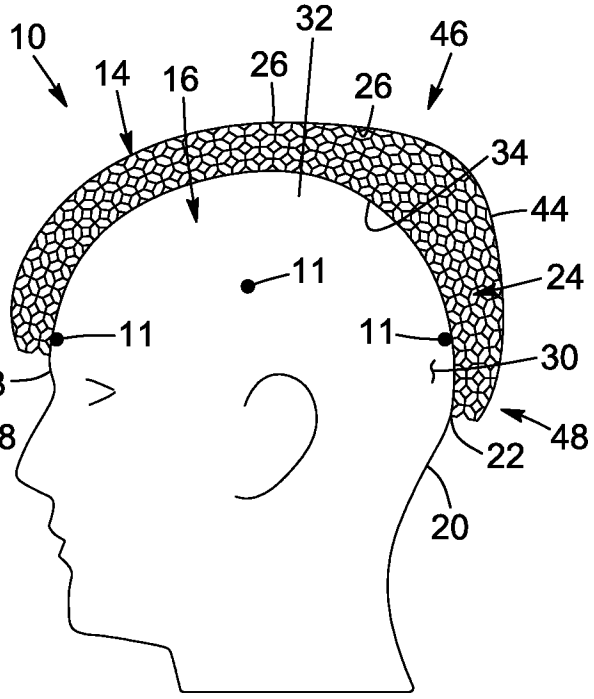
FIG. 22 is a schematic side elevation view of a custom helmet showing a plurality of interrelated microstructures in accordance with an embodiment, wherein interrelated microstructures are added in the rear and upper portion of the custom helmet and interrelated microstructures are eliminated in the rear and lower portion of the custom helmet.
Figure 21:
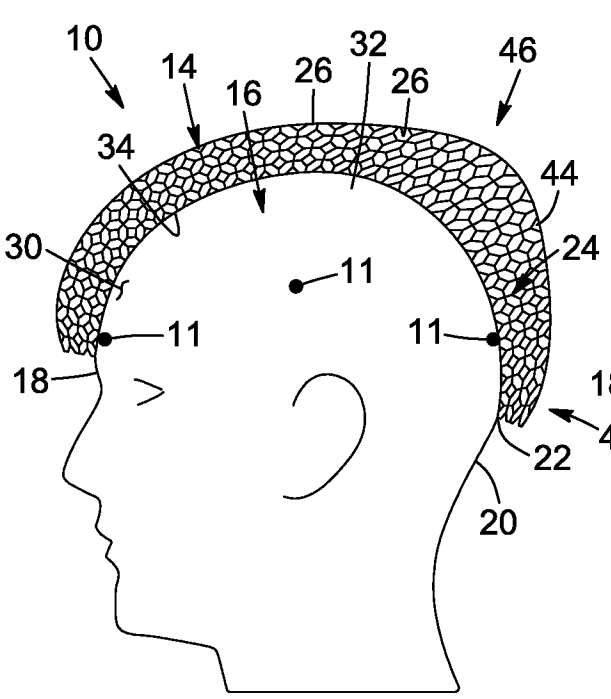
FIG. 21 is a schematic cross-sectional and side elevation view of the custom helmet shown in FIG. 1, wherein the plurality of interrelated microstructures comprises stretched interrelated microstructures in a rear and upper portion of the custom helmet and compressed interrelated microstructures in a rear and lower portion of the custom helmet.
Figure 20:
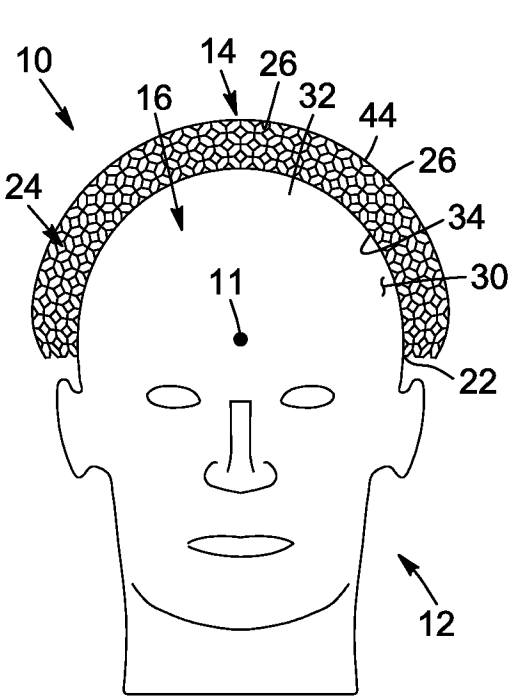
FIG. 20 is a schematic cross-sectional and front elevation view of a custom helmet showing a plurality of interrelated microstructures in accordance with an embodiment, wherein only the custom helmet is shown in cross-sectional view.
Figure 23:
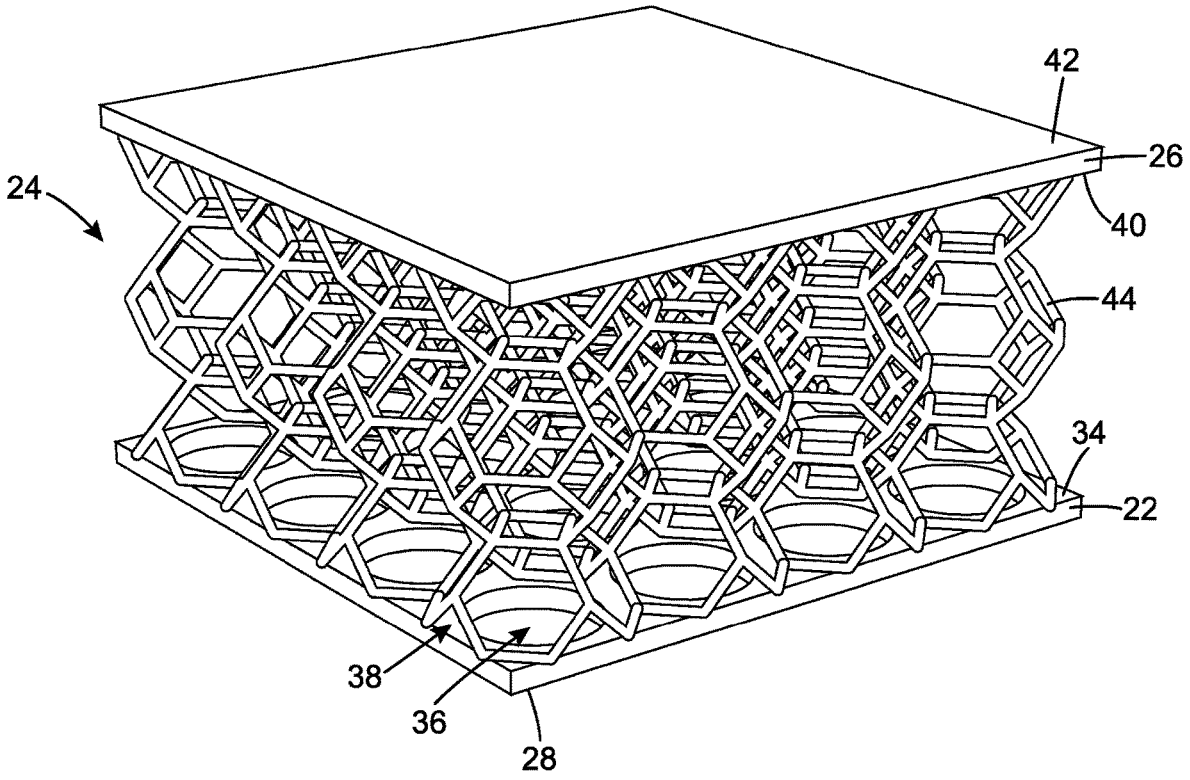
FIG. 23 is a schematic enlarged perspective view of a portion of a custom helmet in accordance with an embodiment.

In accordance with one aspect, and referring to FIGS. 20 to 22, a custom helmet 10 engaged with a specific human head 12 according to an embodiment is shown. The specific human head 12 refers to the head of a given person. The specific human head 12 has particular characteristics such as a given shape and given dimensions, and implies that a model of at least a portion thereof is taken into consideration when designing the custom helmet 10. The model can be conceived for instance using a plurality of head measurement points 11. In an embodiment, the plurality of head measurement points 11 can correspond for example to a distance between two features of the specific human head 12. This aspect will be described in further detail hereinbelow. The custom helmet 10 includes a body 14 surrounding a top portion 16 of the specific human head 12. In FIG. 20, only a portion of the body 14 of the custom helmet 10 is schematically represented on the top portion 16 of the specific human head 12 to show interior components of the custom helmet 10. However, it is to be understood by the person skilled in the art that the custom helmet 10 described herein has a shape similar to the helmets known in the art, i.e. the custom helmet 10 generally covers the entire top portion 16 of the specific human head 12. Similarly, in FIGS. 21 and 22, another portion of the custom helmet 10 is schematically represented, this portion extending from the front 18 to the rear 20 of the specific human head 12 and covering only one hemisphere thereof. Again, it is to be understood by the person skilled in the art that the custom helmet 10 described herein has a shape similar to the helmets known in the art.

In reference to FIGS. 20 to 23, the body 14 of the custom helmet 10 includes an inner shell 22, a 3D closed volumetric mesh 24 and an outer shell 26. The inner shell 22 includes an internal contact surface 28 contacting an outer surface of a specific human head portion 30, i.e. a top part 32 thereof, when the helmet 10 is engaged therewith, and an outwardly facing surface 34 facing the outer shell 26. In an embodiment, the inner shell 22 is made of various types of material such as plastics. The internal contact surface 28 of the inner shell 22 is based on, and in some implementations, intersects with the plurality of head measurement points 11. In some implementations, an offset can be provided between the internal contact surface 28 of the inner shell 22 and the plurality of head measurement points 11. In an embodiment, the head measurements points 11 correspond to specific locations on the specific human head 12, these specific locations being indicative of the outer surface of the specific human head portion 30 and contributing to the customization of the custom helmet 10. For instance, in an embodiment, a head measurement point can correspond to the forwardmost point of the forehead of the specific human head 12 and another measurement point can correspond to the rearmost point of the specific human head 12, and the junction of these two head measurement points through a direct line can correspond to a length of the top part 32 of the specific human head 12. Other measurement points can correspond to a point on each side of the top part 32 of the specific human head 12, and the junction of these two measurement points through a direct line can correspond to a width of the specific human head 12. In certain embodiments, the plurality of head measurement points can include additional design points corresponding to various locations on the specific human head 12, such as design points between each one of the above-mentioned head measurement points, or the additional design points can intersect the internal contact surface 28 at any other location thereon. In an embodiment, adjacent ones of the head measurement points are connected to each other by interpolating curved surfaces therebetween, designing simultaneously the internal contact surface 28. This aspect will be described in more details hereinbelow.

In the illustrated embodiment, the inner shell 22 can include a plurality of inner shell through holes 36 to provide ventilation towards the specific human head. More particularly, the plurality of inner shell through holes 36 define an inner shell aeration pattern and can facilitate an evacuation of heat and/or humidity from the specific human head 12. In an embodiment, the through holes coincide with openings 38 within the 3D closed volumetric mesh 24, as will be described in more details below.

In some implementations, as it will readily be understood by a person skilled in the art, cushion pads may be affixed to the internal contact surface 28 of the inner shell 22 to improve a wear comfort of the custom helmet 10. The cushion pads can comprise for instance foam material or the like. In some embodiments, the cushion pads may be affixed with adhesives or with hook-and-loop fasteners, or with any other suitable fasteners.

The outer shell 26 of the custom helmet 10 includes an internal surface 40 facing the inner shell 22, and an outwardly facing surface 42. In some embodiments, the outer shell 26 may be made of the same material as the inner shell 22. In an embodiment, the inner shell 22, the 3D closed volumetric mesh 24 and the outer shell 26 are made of the same material and are 3D printed as a single piece. In an embodiment, the ends of the 3D closed volumetric mesh 24 merge with the inner shell 22 and the outer shell 26 to provide a relatively strong unit.

In some implementations, the outwardly facing surface 42 of the outer shell 26 is an outmost surface of the custom helmet 10. In other implementations, the outwardly facing surface 42 of the outer shell 26 may include a reinforcement layer and/or an aesthetic cover (not shown) positioned onto the outer shell 26.

The thickness of the inner shell 22 and the outer shell 26 may vary according to different factors, such as sharp object impact protection, geometry fidelity trough usage, rules of material retraction regarding geometric intersections, comfort, optimal weight, additive manufacturing constraints. In some embodiments, the thickness of the inner shell 22 is between 0.5 mm and 2 mm, while the thickness of the outer shell 26 is between 0.5 mm and 3 mm. In the embodiment where the outer shell 26 includes a reinforcement layer, the thickness of the outer shell 26 can be chosen taking into consideration a thickness of the reinforcement layer, such that when both the outer shell 26 and the reinforcement layer are combined, a resulting thickness can contribute to the shock absorption of the 3D closed volumetric mesh 24. In another embodiment where the outer shell 26 is an aesthetic cover, the outer shell 26 may be a relatively thin decorative layer, and minimally contributes to the thickness of the outer shell 26.

In an embodiment, the outer shell 26 has a predetermined curvature and shape. It can be selected from a library of outer shells 26, wherein each one of the outer shells is characterized by a curvature, a shape, a ventilation pattern, a rib pattern, and the like.

The outer shell 26 is positioned at a distance from the inner shell 22 such that the internal contact surface 34 of the inner shell 22 and the internal surface 40 of the outer shell 26 define an internal volume thereinbetween. In an embodiment, the distance between the internal contact surface 34 of the inner shell 22 and the internal surface 40 of the outer shell 26 is predetermined. The distance corresponds to a distance that is sufficient for the 3D closed volumetric mesh 24 to fit therein, and more specifically, to fit a 3D volumetric mesh therein having required characteristics so that it can contribute to the shock attenuation properties of the custom helmet. On the other hand, the distance can be a predetermined distance set according to safety standards, in which case the characteristics of the 3D volumetric mesh 24 are adapted to provide adequate shock attenuation properties within the internal volume resulting from the predetermined distance. In an embodiment, the distance between the internal contact surface 34 of the inner shell 22 and the internal surface 40 of the outer shell 26 can be between about between 18 mm and about 50 mm, and, in an alternative embodiment, about 18 mm and 40 mm. In other embodiments, the distance between the internal contact surface 34 of the inner shell 22 and the internal surface 40 of the outer shell 26 can be between about 20 mm and 27 mm.

In some embodiments, the 3D volumetric mesh 24 can be made of two or more sections, each separated by a thin layer. Each section can have different characteristics, such that particular properties for each section can be obtained. For instance, the density of one section can be higher than the other.

In an embodiment, as shown in FIGS. 20 to 22, the distance between the internal contact surface 34 of the inner shell 22 and the internal surface 40 of the outer shell 26 can be variable. For instance, it can be thinner closer to the edges of the custom helmet 10 and thicker in the upper and rear portion to increase the shock attenuation properties. The distance can thus be determined at predetermined positions along the custom helmet 10 and can be adjusted in accordance with the shape and the curvature of the outer shell 26.

Still referring to FIGS. 20 to 23, the 3D closed volumetric mesh 24 includes a plurality of interrelated polyhedral microstructures 44. In an embodiment, the size and the shape of the interrelated polyhedral microstructures 44 enable the 3D closed volumetric mesh 24 to absorb a given impact. For example, the given impact can be an impact corresponding to the force of impact following a fall of a cyclist on a paved road, i.e. a fall of about 2 meters.

It is appreciated that the shape, the size and the interconnection of the interrelated polyhedral microstructures 44 defining the 3D closed volumetric mesh 24 can vary from the embodiments shown in the accompanying figures.

In some implementations, the size and the shape of the interrelated polyhedral microstructures 44 can be adapted in order for the 3D closed volumetric mesh 24 to fill the internal volume according to a given pattern. The size and the shape of the interrelated polyhedral microstructures 44 can also be adapted in order for the interrelated polyhedral microstructures 44 to deform permanently upon a given impact or so that the interrelated polyhedral microstructures 44 can regain their original shape after a shock attenuation, whether they are rigid or flexible. In an embodiment, the size and the shape of the interrelated polyhedral microstructures 44 can be adapted so as to result in an aerodynamic outline of the custom helmet 10. For instance, some of the plurality of interrelated polyhedral microstructures 44 can be stretched with respect to their original and predetermined size, whereas other interrelated polyhedral microstructures of the plurality of interrelated polyhedral microstructures 44 can be compressed with respect to their original and predetermined size. For instance, in reference to FIG. 21, the interrelated polyhedral structures 44 located at an upper rear portion 46 of the custom helmet are stretched, whereas the interrelated polyhedral microstructure 44 located at a lower rear portion 48 of the custom helmet 10 are compressed. In the embodiment shown in Figure XX, the pattern of the interrelated polyhedral microstructures 44 allows for two complete rows thereof to fill the internal volume, i.e. without having partial polyhedral microstructure filling the internal volume. It is appreciated that the number of microstructure rows can vary from the embodiment shown. Partial polyhedral microstructures, in this context, refers to polyhedral structures that are cut in order to offer a resting surface to position thereon an outer shell with a particular shape and/or at a particular distance. In contrast, the stretching and the compressing of the polyhedral microstructures as described herein can allow to preserve the structural integrity, i.e. the entire shape, of each one of the polyhedral microstructures 44, which can contribute to the impact attenuation properties of the custom helmet 10. Stretching and compression of some of the interrelated polyhedral microstructure 44 can be performed by allowing deviation from the angles at the vertices and the length of the edges of the basic convex polyhedral object characterized by a basic shape and a basic size. Thresholds can be provided to control the deformation of the interrelated polyhedral microstructure 44 within an acceptable limit.

In other embodiments, additional polyhedral microstructures 44 can be added or subtracted at specific locations of the custom helmet 10. Hence, in the embodiment illustrated in FIG. 22, additional polyhedral microstructures 44 are present in the upper rear portion 46 of the custom helmet 10, while fewer polyhedral microstructures 44 are present in the lower rear portion 48 of the custom helmet 10. It is appreciated that partial additional polyhedral microstructures can be added or subtracted to intersect with one of the internal contact surface 34 of the inner shell 22 and the outer shell 26. In some implementations, partial additional polyhedral microstructures contact the outer shell 26 in some portions thereof.

Optionally, in some implementations, the custom helmet 10 can include at least one ventilation opening (not shown). The at least one ventilation opening can be, for instance, a ventilation opening through the outer shell 26, which can allow cooling air to enter in the internal volume of the custom helmet 10 and circulate through the interrelated polyhedral structures 44 and reach a portion of the specific human head 12 through the plurality of inner shell through holes 36 in the inner shell 22. In other implementations, the at least one ventilation opening can also include a ventilation opening through the 3D closed volumetric mesh 24 of the custom helmet 10, i.e. a discontinuity in the 3D closed volumetric mesh 24 defining the ventilation opening, the opening being sized and shaped to allow cooling air to contact the specific human head portion 30. Similarly, in an embodiment, the inner shell 22 can also include a ventilation opening which can be in register, or substantially aligned, with the ventilation openings defined in the outer shell 26 and the 3D closed volumetric mesh 24 to define the ventilation opening extending through the custom helmet 10. The surface area of the ventilation opening(s) are wider than the through holes provided in the inner shell 22.

Method for Conceiving and Manufacturing the Custom Helmet

Figure 24:
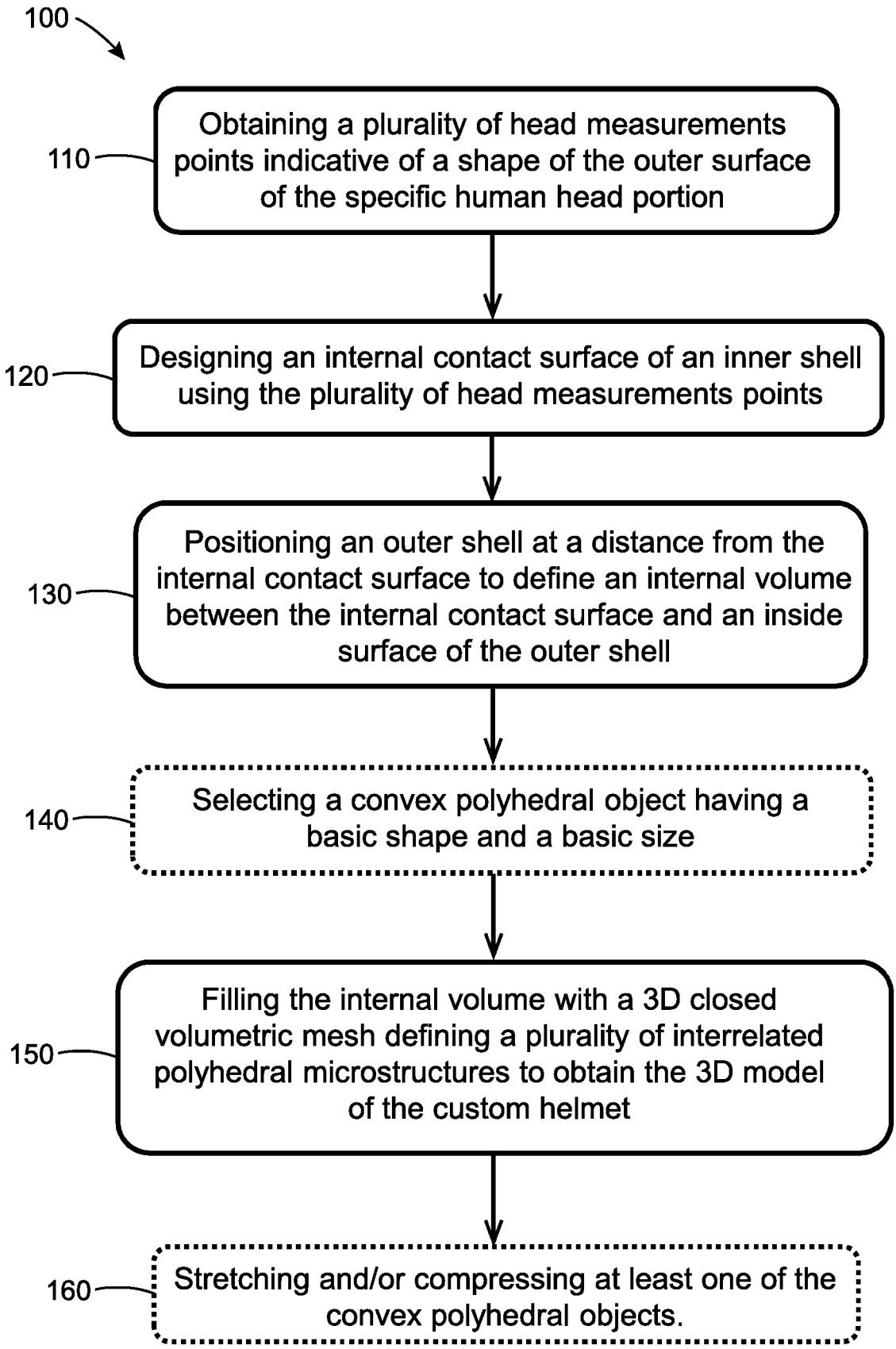
FIG. 24 is a flowchart of a method for conceiving a 3D model of the custom helmet, according to the embodiment of FIGS. 20 to 22.

In accordance with another aspect, and with reference to FIG. 24, there is provided a method 100 for conceiving a 3D model of the custom helmet as described herein. The method includes the following steps.

A plurality of head measurement points indicative of the shape of the outer surface of the specific human head is obtained 110. In the context of the method described herein, the head measurement points correspond to specific locations on the outer surface of the specific human head portion 30, such that, by intersecting each one of the head measurement points with a common surface, a resulting surface substantially conforming to at least a portion of the specific human head portion 30 can be obtained. In an embodiment, an offset can be provided between the surface and the head measurement points. This aspect will be described in further details hereinbelow.

In an embodiment, the plurality of measurement points can be obtained directly on the specific human head portion 30 by a contact method, for instance by using a dedicated tool such as a probe directly on the specific human head portion 30 at specific locations thereof to measure and record the head measurement points. Other dedicated tool can include, without being limited to, custom manual gauge, touch probe scanner, 3D laser scanner, and the like. In another embodiment, a head cap can be used to obtain the plurality of head measurement points. In such an embodiment, the head cap can be placed on the specific human head portion 30 so that the plurality of head measurement points can be recorded. Subsequently and when required, the plurality of head measurement points obtained using the head cap can be retrieved and used in another step of the method. In another embodiment, a photogrammetric analysis method can be used to obtain the plurality of head measurement points. For example, at least one photograph of a specific human head portion can be used to determine the position of the plurality of head measurement points. The head cap and the photogrammetric analysis mentioned hereinabove can allow, for instance, a person who is located at a remote location from the location where the 3D model of the custom helmet is conceived to provide the required plurality of head measurement points for subsequent steps of the method.

In some implementations, obtaining the plurality of head measurement points indicative of the shape of the outer surface of the specific human head 30 can further include using an outer surface of a generic human head portion to determine a generic outer surface, and modifying the generic outer surface using the plurality of head measurement points indicative of the shape of the outer surface of the specific human head portion 30 obtained by any of the hereinabove mentioned techniques.

An internal contact surface 28 is designed using the plurality of head measurement points 120 indicative of the shape of the outer surface of the specific human head portion 30. The design can be performed for instance using polygonal modeling, sub-d polygonoal modeling, NURBS modeling, by joining each one of the plurality of head measurement points to form surfaces thereinbetween, therefore creating a resulting surface intersecting each one of the head measurement points to substantially conform to at least a portion of the outer surface of the specific human head portion. In an embodiment, an offset, which can be predetermined, can be provided between the head measurement points and the surface.

An outer shell 26 is designed and/or selected. In an embodiment, the outer shell 26 can be selected from a library of outer shell including a plurality of outer shells characterized by a curvature, a shape, a ventilation pattern, a rib pattern, and the like.

Then, the selected or designed outer shell 26 is positioned at a distance from the internal contact layer 130, i.e. the outer shell and the internal contact layer are spaced apart from one another. In an embodiment, the distance is predetermined and chosen according to various considerations. In some embodiments, the predetermined distance can be dictated by impact attenuation requirements of safety standards for a given usage of the custom helmet, which can require for instance that a protective wearable is capable of attenuating an impact under a given set of circumstances. The distance of the outer shell from the internal contact surface defines an internal volume between the internal contact surface and an inside surface of the outer shell.

In an embodiment, a 3D closed volumetric mesh 24 characterized by polyhedral microstructures 44 is designed and/or selected. In an embodiment, the 3D closed volumetric mesh 24 can be selected from a library of 3D closed volumetric meshes including a plurality of polyhedral microstructures characterized by a shape, a size, an interconnection patter, and the like.

Thus, in some implementations, the method further includes selecting a convex polyhedral object having a basic shape and a basic size 140 to fill the internal volume 150 therewith by interconnecting a plurality of the convex polyhedral object. In such an embodiment, the interconnected convex polyhedral objects form the 3D closed volumetric mesh 24. It is to be understood by the person skilled in the art that the interconnecting of the plurality of convex polyhedral objects entails that at least one segment of two adjacent convex polyhedral objects is common to both adjacent convex polyhedral objects. The basic shape of the convex polyhedral object can be any shape a polyhedron can have, for instance and without being limitative a polyhedron having a number of faces between 4 and 14, a number of vertices between 4 and 24, and a number of edges between 6 and 36. In an embodiment, the size of the convex polyhedral object is determined according to impact standard requirements, similarly to and in conjunction with the choice of the distance between the inner shell 22 and the outer shell 26.

The internal volume 150 is then filled with the selected and/or designed 3D closed volumetric mesh 24 defining a plurality of interrelated polyhedral microstructures 44 to obtain the 3D model of the custom helmet 10. In an embodiment, filing the internal volume comprises projecting lines outwardly from the plurality of head measurements points 11 up to the internal surface 40 of the outer shell 26 of the 3D model to obtain a plurality of outwardly extending projecting lines extending from the internal contact surface 28. The plurality outwardly extending projecting lines, by intersecting each other within the internal volume, creates a plurality of 3D volumes filling the internal volume. In an embodiment, filling the internal volume also includes positioning the 3D closed volumetric mesh 24 based on the plurality of outwardly extending projecting lines.

In an embodiment, the filling of the internal volume with the 3D closed volumetric mesh 24 includes stretching and/or compressing at least one interconnected convex object of the plurality of interconnected convex objects 160, using for instance polygonal modeling, sub-d polygonal modeling, NURBS modeling or curve modeling, to fill the internal volume. The choice of stretching or compressing is made according to a desired resulting pattern of the 3D closed volumetric mesh, this desired pattern being determined, amongst other, by the required distance between the outer shell and the inner shell, by the desired outside shape of the custom helmet and/or by internal contact surface shape considerations. In such an embodiment, simulated impact tests can be performed to optimize any one of the distance between the outer shell and the inner shell, the selection of the convex polyhedral object, the size and/or shape of the convex polyhedral object and the necessity of stretching and/or compressing any one of the convex polyhedral object.

Optionally, in an embodiment, the filing of the internal volume between the internal contact surface of the inner shell and the internal layer of the outer shell includes determining additional design points on the internal contact surface and projecting lines outwardly from the additional design points to the inside surface of the outer shell to obtain additional outwardly extending projecting lines. The additional design points are points that are extrapolated from the head measurement points and can be, for instance, any point intersecting an edge between the already obtained head measurement points, or can be obtained by any other suitable method. It is to be noted that in some scenarios, the head measurement points, including the additional design points, can be substantially equidistant from one another. In such an embodiment, positioning the 3D closed volumetric mesh based on the plurality of outwardly extending projecting lines includes positioning the 3D closed volumetric mesh based on the additional outwardly extending projecting lines. Thus, the combination of the outwardly extending protecting lines and the additional outwardly extending projecting lines allows the interconnections between each volume of the 3D volumetric mesh to occur at a higher frequency, which can, in some scenarios, contribute to better define the 3D closed volumetric mesh.

In accordance with another aspect, there is provided a method for manufacturing the custom helmet described herein. The method includes the steps described hereinabove to conceive the 3D model of the custom helmet. Then, the 3D model of the custom helmet is printed, for example by using a 3D printer, in order to manufacture the custom helmet.

It will be appreciated that the method described herein may be performed in the described order, or in any suitable order.

Several alternative embodiments and examples have been described and illustrated herein. The embodiments of the helmet and/or the custom helmet described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the helmet or the custom helmet may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A helmet engageable with a human head portion, comprising:

an inner shell comprising an internal surface configured to face at least a section of the human head portion when the helmet is worn;

an outer shell comprising an inner surface facing the inner shell and an outwardly facing surface, the outer shell being positioned at a distance from the inner shell and defining an internal volume between an outer surface of the inner shell and the inner surface of the outer shell; and a shock absorbing layer located between the inner shell and the outer shell, the shock absorbing layer comprising at least one 3D structure and defined by a plurality of interconnected surfaces, said plurality of interconnected surfaces comprising a plurality of openings, said plurality of openings being defined between said plurality of interconnected surfaces and being oriented along at least two non-parallel axes to allow air circulation inside the shock absorbing layer, the at least one 3D structure filling at least partially the internal volume between the inner shell and the inner surface of the outer shell and maintaining the outer shell spaced-apart from the inner shell.

2. The helmet as claimed in claim 1, wherein the shock absorbing layer is made from a 3D-printed material and comprises a plurality of superposed and connected layers of the interconnected surfaces defining a 3D periodic pattern.

3. The helmet as claimed in claim 2, wherein the inner shell and the outer shell are made from a 3D-printed material and printed as a single piece with the shock absorbing layer.

4. The helmet as claimed in claim 1, wherein the plurality of interconnected surfaces is based on minimal surfaces.

5. The helmet as claimed in claim 4, wherein the interconnected surfaces are based on a gyroid.

6. A helmet engageable with a human head portion, comprising:

an inner shell comprising an internal surface configured to face at least a section of the human head portion when the helmet is worn;

an outer shell comprising an inner surface facing the inner shell and an outwardly facing surface, the outer shell being positioned at a distance from the inner shell and defining an internal volume between an outer surface of the inner shell and the inner surface of the outer shell; and a shock absorbing layer located between the inner shell and the outer shell, the shock absorbing layer comprising at least one 3D structure and defined by a plurality of interconnected surfaces, said plurality of interconnected surfaces comprising a plurality of openings, said plurality of openings being defined between said plurality of interconnected surfaces and defining non-linear air circulation paths to allow air circulation inside the shock absorbing layer, the at least one 3D structure filling at least partially the internal volume between the inner shell and the inner surface of the outer shell and maintaining the outer shell spaced-apart from the inner shell.

7. The helmet as claimed in claim 6, wherein the shock absorbing layer is secured to the inner shell and the outer shell.

8. The helmet as claimed in claim 6, wherein the helmet comprises a plurality of helmet portions secured together, wherein at least two of the helmet portions comprises a respective one of the inner shell, a respective one of the outer shell, and a respective one of the shock absorbing layer extending between the respective ones of the inner and outer shells.

9. The helmet as claimed in claim 6, wherein the helmet comprises a plurality of helmet portions, at least two of the helmet portions including a respective of one the shock absorbing layer and the at least two shock absorbing layers are sandwiched and extend between the inner shell and the outer shell and, wherein the inner shell and the outer shell are made from a 3D-printed material and printed as a single piece with the shock absorbing layer.

10. The helmet as claimed in claim 6, wherein the inner shell and the outer shell comprises throughout apertures with the throughout apertures defined in the outer shell being smaller in diameter than the throughout apertures defined in the inner shell and at least one portion of the shock absorbing layer is exposed outwardly.

11. The helmet as claimed in claim 6, wherein at least one portion of the shock absorbing layer is exposed outwardly.

12. The helmet as claimed in claim 6, wherein the plurality of interconnected surfaces defines a 3D periodic pattern and is based on minimal surfaces.

13. A helmet engageable with a human head portion, comprising:

an inner shell comprising an internal surface configured to face at least a section of the human head portion when the helmet is worn;

an outer shell comprising an inner surface facing the inner shell and an outwardly facing surface, the outer shell being positioned at a distance from the inner shell and defining an internal volume between an outer surface of the inner shell and the inner surface of the outer shell; and a shock absorbing layer located between the inner and outer shells, the shock absorbing layer comprising a 3D structure defined by a plurality of interconnected minimal surfaces, said plurality of interconnected minimal surfaces comprising a plurality of openings, said plurality of opening being defined between said plurality of interconnected surfaces and being oriented along at least two non-parallel axes to allow air circulation inside the shock absorbing layer, the 3D structure at least partially filling the internal volume between the inner shell and the inner surface of the outer shell and maintaining the outer shell spaced-apart from the inner shell.

14. The helmet as claimed in claim 13, wherein the shock absorbing layer is secured to the inner shell and the outer shell.

15. The helmet as claimed in claim 13, wherein the shock absorbing layer is made from a 3D-printed material and comprises a plurality of superposed and connected layers of the interconnected minimal surfaces.

16. The helmet as claimed in claim 15, wherein the inner shell and the outer shell are made from a 3D-printed material and printed as a single piece with the shock absorbing layer.

17. The helmet as claimed in claim 15, wherein the plurality of interconnected minimal surfaces defines a 3D periodic pattern.

18. The helmet as claimed in claim 13, wherein the plurality of interconnected minimal surfaces is based on a gyroid.

19. The helmet as claimed in claim 13, wherein the helmet comprises a plurality of helmet portions secured together, wherein at least two of the helmet portions comprises a respective one of the inner shell, a respective one of the outer shell, and a respective one of the shock absorbing layer extending between the respective ones of the inner and outer shells.

20. The helmet as claimed in claim 13, wherein the helmet comprises a plurality of helmet portions, at least two of the helmet portions including a respective of one the shock absorbing layer and the at least two shock absorbing layers are sandwiched and extend between the inner shell and the outer shell.

21. The helmet as claimed in claim 13, wherein the inner shell and the outer shell comprises throughout apertures with the throughout apertures defined in the outer shell being smaller in diameter than the throughout apertures defined in the inner shell.

* * * * *